US010078278B2

(12) United States Patent
Murata et al.

(10) Patent No.: US 10,078,278 B2
(45) Date of Patent: Sep. 18, 2018

(54) PROCESS FOR PRODUCING TONER FOR DEVELOPMENT OF ELECTROSTATIC IMAGES

(71) Applicant: KAO CORPORATION, Tokyo (JP)

(72) Inventors: Shoichi Murata, Wakayama (JP); Tomohide Yoshida, Wakayama (JP); Hiroto Hayashi, Wakayama (JP); Motomu Shibata, Izumiotsu (JP)

(73) Assignee: KAO CORPORATION, Tokyo (JP)

( * ) Notice: Subject to any disclaimer, the term of this patent is extended or adjusted under 35 U.S.C. 154(b) by 0 days.

(21) Appl. No.: 15/315,117

(22) PCT Filed: Jun. 10, 2015

(86) PCT No.: PCT/JP2015/067381

§ 371 (c)(1),
(2) Date: Nov. 30, 2016

(87) PCT Pub. No.: WO2015/190620

PCT Pub. Date: Dec. 17, 2015

(65) Prior Publication Data

US 2017/0199473 A1 Jul. 13, 2017

(30) Foreign Application Priority Data

Jun. 13, 2014 (JP) ..... 2014-122481

(51) Int. Cl.

| | |
|---|---|
| ***G03G 9/08*** | (2006.01) |
| ***G03G 9/093*** | (2006.01) |
| ***G03G 9/087*** | (2006.01) |
| ***G03G 9/09*** | (2006.01) |

(52) U.S. Cl.

CPC ..... *G03G 9/0806* (2013.01); *G03G 9/0804* (2013.01); *G03G 9/08711* (2013.01); *G03G 9/08755* (2013.01); *G03G 9/0918* (2013.01); *G03G 9/09328* (2013.01); *G03G 9/09364* (2013.01); *G03G 9/09371* (2013.01); *G03G 9/09392* (2013.01)

(58) Field of Classification Search

CPC ..... G03G 9/0806; G03G 9/0918; G03G 9/09328; G03G 9/09371; G03G 9/09364; G03G 9/08755; G03G 9/08711; G03G 9/0804; G03G 9/09392

See application file for complete search history.

(56) References Cited

U.S. PATENT DOCUMENTS

| | | | | |
|---|---|---|---|---|
| 9,110,392 | B2 | 8/2015 | Fukuri | |
| 2007/0020551 | A1 | 1/2007 | Sasaki et al. | |
| 2009/0297977 | A1 | 12/2009 | Sasaki et al. | |
| 2013/0004890 | A1 | 1/2013 | Obara et al. | |
| 2013/0330666 | A1* | 12/2013 | Fukuri ..... | G03G 9/08755 430/109.4 |
| 2013/0330667 | A1 | 12/2013 | Fukuri | |

FOREIGN PATENT DOCUMENTS

| | | | |
|---|---|---|---|
| JP | 2007-114398 | A | 5/2007 |
| JP | 2007-279195 | A | 10/2007 |
| JP | 2011-247932 | A | 12/2011 |
| JP | 2012-88345 | A | 5/2012 |
| JP | 2012-118236 | A | 6/2012 |
| JP | 2014-13384 | A | 1/2014 |
| JP | 2014-186092 | A | 10/2014 |

OTHER PUBLICATIONS

International Search Report dated Aug. 26, 2015 in PCT/JP2015/067381 filed Jun. 10, 2015.

* cited by examiner

*Primary Examiner* — Thorl Chea

(74) *Attorney, Agent, or Firm* — Oblon, McClelland, Maier & Neustadt, L.L.P.

(57) ABSTRACT

The present invention relates to a process for producing a toner for development of electrostatic images, including the following steps (1) to (3): Step (1): aggregating resin particles (X) containing a composite resin that contains a segment constituted of a polyester resin (a) obtained by polycondensing an alcohol component containing 80 mol % or more of a propyleneoxide adduct of bisphenol A and a polycarboxylic acid component, and a vinyl-based resin segment containing a constitutional unit derived from a styrene-based compound, in an aqueous medium, to obtain aggregated particles (1); Step (2): aggregating the aggregated particles (1) obtained in the step (1) with resin particles (Y) containing a polyester resin (b) obtained by polycondensing an alcohol component containing 80 mol % or more of an ethyleneoxide adduct of bisphenol A and a polycarboxylic acid component to obtain aggregated particles (2); and Step (3): coalescing the aggregated particles (2) obtained in the step (2).

19 Claims, No Drawings

PROCESS FOR PRODUCING TONER FOR DEVELOPMENT OF ELECTROSTATIC IMAGES

FIELD OF THE INVENTION

The present invention relates to a process for producing a toner for development of electrostatic images, and a toner for development of electrostatic images.

BACKGROUND OF THE INVENTION

In the field of electrophotography, with the progress of electrophotographic systems, it has been demanded to develop toners for electrophotography adaptable for high image quality and high copying or printing speed. To meet a high image quality of the toners, there are known processes for producing toners having a narrow particle size distribution and a small particle size by an aggregating and coalescing method (emulsification-aggregation method or aggregation-coalescence method) in which fine resin particles, etc., are aggregated and coalesced together in an aqueous medium. Among them, in order to improve thermal properties such as a low-temperature fusing property and a heat-resistant storage stability, there have been proposed toners having a core-shell structure.

For example, JP 2014-13384A discloses a toner for electrophotography including core-shell particles each constituted of a core that contains a non-crystalline composite resin (A) containing a segment (A1) formed of a polyester resin and a segment (A2) formed of an addition polymer containing styrene as a constitutional unit, and a shell that contains a non-crystalline resin (B) obtained by polycondensing an alcohol component containing an aliphatic diol having 2 to 6 carbon atoms and a carboxylic acid component. In JP 2014-13384A, it is described that the toner for electrophotography is excellent in low-temperature fusing property and anti-hot offset property.

JP 2011-247932A discloses a core-shell type toner for development of electrostatic images including a core layer and a shell layer formed of a resin which covers the core layer, in which the core layer includes a core aggregate obtained by aggregating core particles containing a graft polyester resin produced by graft-polymerizing a polyester resin with a polymerizable vinyl monomer, a wax and a wax dispersing assistant. In JP 2011-247932A, it is described that the core-shell type toner for development of electrostatic images has a small particle size, and is excellent in low-temperature fusing property, separating property upon fusion, and storage stability.

Further, JP 2007-114398A discloses a toner for electrophotography having a structure including core particles each containing at least a resin binder, a colorant and a releasing agent, and a shell layer that covers the respective core particles, in which 75% by mass or more of the resin binder contained in the core particles is constituted of a polyester resin A and 75% by mass or more of the shell layer is constituted of a polyester resin B, a ratio (mol %) of isophthalic acid to a total amount of carboxylic acids constituting the polyester resin A and a ratio (mol %) of isophthalic acid to a total amount of carboxylic acids constituting the polyester resin B satisfy a specific relational formula, and solubility parameters (SP values) of the polyester resin A and the polyester resin B satisfy a specific relational formula. In JP 2007-114398A, it is described that the toner for electrophotography is not only free from problems such as exposure of internal additives of the toner to an outer surface thereof and separation of the shell layer, but also capable of satisfying a good low-temperature fusing property, a high gloss of images and a prolonged service life of a developer.

Furthermore, JP 2012-118236A discloses a process for producing a toner for electrophotography which has a sharp particle size distribution, satisfies both of a good low-temperature fusing property and a good storage stability, and is improved in toner cloud, which process includes a step (1) of melting and mixing a crystalline polyester (a) and a non-crystalline polyester (b) produced by polycondensing an alcohol component containing 80 mol % or more of a propyleneoxide adduct of bisphenol A and a carboxylic acid component, and emulsifying the resulting mixture in an aqueous medium to obtain resin particles (A); a step (2) of aggregating the resin particles (A) to obtain aggregated particles; a step (3) of adding resin particles (C) containing a non-crystalline polyester (c) obtained by polycondensing an alcohol component containing 80 mol % or more of an ethyleneoidde adduct of bisphenol A and a carboxylic acid component to a dispersion of the aggregated particles to obtain core-shell particles; and a step (4) of maintaining a system containing the core-shell particles at a temperature that is not lower than a temperature lower by 5° C. than a glass transition point of the non-crystalline polyester (c) to obtain coalesced core-shell particles.

SUMMARY OF THE INVENTION

That is, the present invention relates to the following aspects [1] and [2].

[1] A process for producing a toner for development of electrostatic images, including the following steps (1) to (3):

Step (1): aggregating resin particles (X) containing a composite resin that contains a segment constituted of a polyester resin (a) obtained by polycondensing an alcohol component containing 80 mol % or more of a propyleneoxide adduct of bisphenol A and a polycarboxylic acid component, and a vinyl-based resin segment containing a constitutional unit derived from a styrene-based compound, in an aqueous medium, to obtain aggregated particles (1);

Step (2): aggregating the aggregated particles (1) obtained in the step (1) with resin particles (Y) containing a polyester resin (b) obtained by polycondensing an alcohol component containing 80 mol % or more of an ethyleneoxide adduct of bisphenol A and a polycarboxylic acid component to obtain aggregated particles (2); and Step (3): coalescing the aggregated particles (2) obtained in the step (2).

[2] A toner for development of electrostatic images which has a core-shell structure, including:

a core portion containing a composite resin that contains a segment constituted of a polyester resin (a) obtained by polycondensing an alcohol component containing 80 mol % or more of a propyleneoxide adduct of bisphenol A and a polycarboxylic acid component, and a vinyl-based resin segment containing a constitutional unit derived from a styrene-based compound; and a shell portion containing a polyester resin (b) obtained by polycondensing an alcohol component containing 80 mol % or more of an ethyleneoxide adduct of bisphenol A and a polycarboxylic acid component.

DETAILED DESCRIPTION OF THE INVENTION

In the technology described in JP 2014-13384A, the core and shell of the core-shell particles are respectively constituted of specific resin components to improve a low-temperature fusing property and an anti-hot offset property of the toner. However, the resulting toner still fails to satisfy both of a good low-temperature fusing property and a good heat-resistant storage stability, and therefore there is a demand for further improvement in properties of the toner.

In the technology described in JP 2011-247932A, the core layer of the respective core-shell particles is constituted of core particles containing a wax and a wax dispersing assistant to improve a low-temperature fusing property of the toner. However, the resulting toner tends to be still unsatisfactory in heat-resistant storage stability, and therefore there is a demand for further improvement in properties of the toner.

Further, in the technologies described in JP 2007-114398A and JP 2012-118236A, the resulting toners tend to be still unsatisfactory from the viewpoint of satisfying both of a good low-temperature fusing property and a good heat-resistant storage stability.

Thus, the present invention relates to a process for producing a toner for development of electrostatic images which is capable of obtaining a toner having excellent low-temperature fusing property and heat-resistant storage stability, and a toner for development of electrostatic images which is excellent in low-temperature fusing property and heat-resistant storage stability.

The present inventors have found that in the process for producing a toner for development of electrostatic images which has a core-shell structure, when resins constituting a core portion and a shell portion of the toner are respectively capable of satisfying a composition having a specific content of a specific monomer component, it is possible to obtain a toner for development of electrostatic images which is excellent in both of low-temperature fusing property and heat-resistant storage stability.

That is, the present invention relates to the following aspects [1] and [2].

[1] A process for producing a toner for development of electrostatic images, including the following steps (1) to (3):

Step (1): aggregating resin particles (X) containing a composite resin that contains a segment constituted of a polyester resin (a) obtained by polycondensing an alcohol component containing 80 mol % or more of a propyleneoxide adduct of bisphenol A and a polycarboxylic acid component, and a vinyl-based resin segment containing a constitutional unit derived from a styrene-based compound, in an aqueous medium, to obtain aggregated particles (1);

Step (2): aggregating the aggregated particles (1) obtained in the step (1) with resin particles (Y) containing a polyester resin (b) obtained by polycondensing an alcohol component containing 80 mol % or more of an ethyleneoxide adduct of bisphenol A and a polycarboxylic acid component to obtain aggregated particles (2); and Step (3): coalescing the aggregated particles (2) obtained in the step (2).

[2] A toner for development of electrostatic images which has a core-shell structure, including;

a core portion containing a composite resin that contains a segment constituted of a polyester resin (a) obtained by polycondensing an alcohol component containing 80 mol % or more of a propyleneoxide adduct of bisphenol A and a polycarboxylic acid component, and a vinyl-based resin segment containing a constitutional unit derived from a styrene-based compound; and a shell portion containing a polyester resin (b) obtained by polycondensing an alcohol component containing 80 mol % or more of an ethyleneoxide adduct of bisphenol A and a polycarboxylic acid component.

In accordance with the present invention, it is possible to provide a process for producing a toner for development of electrostatic images which is capable of obtaining a toner having excellent low-temperature fusing property and heat-resistant storage stability, and a toner for development of electrostatic images which is excellent in low-temperature fusing property and heat-resistant storage stability.

[Process for Producing Toner for Development of Electrostatic Images]

The process for producing a toner for development of electrostatic images according to the present invention includes the following steps (1) to (3):

Step (1): aggregating resin particles (X) containing a composite resin that contains a segment constituted of a polyester resin (a) obtained by polycondensing an alcohol component containing 80 mol % or more of a propyleneoxide adduct of bisphenol A and a polycarboxylic acid component, and a vinyl-based resin segment containing a constitutional unit derived from a styrene-based compound, in an aqueous medium, to obtain aggregated particles (1);

Step (2): aggregating the aggregated particles (1) obtained in the step (1) with resin particles (Y) containing a polyester resin (b) obtained by polycondensing an alcohol component containing 80 mol % or more of an ethyleneoxide adduct of bisphenol A and a polycarboxylic acid component to obtain aggregated particles (2); and Step (3): coalescing the aggregated particles (2) obtained in the step (2).

The reason why the toner for development of electrostatic images which is produced by the production process according to the present invention (hereinafter also referred to merely as a "toner") is excellent in low-temperature fusing property and heat-resistant storage stability, is considered as follows, though it is not clearly determined.

That is, the core portion of the toner obtained by the production process of the present invention contains the composite resin containing the segment constituted of the polyester resin (a) obtained from the alcohol component as the raw material containing the propyleneoxide adduct of bisphenol A as a main constitutional unit thereof (hereinafter also referred to as a "polyester segment"), and the vinyl-based resin segment containing a constitutional unit derived from the styrene-based compound, whereas the shell portion of the toner obtained by the production process of the present invention contains the polyester resin (b) obtained from the alcohol component as the raw material containing the ethyleneoxide adduct of bisphenol A as a main constitutional unit thereof.

The segment constituted of the polyester resin (a) obtained from the alcohol component as the raw material containing the propyleneoxide adduct of bisphenol A as a main constitutional unit thereof which is contained in the composite resin in the core has a low compatibility with the polyester resin (b) obtained from the alcohol component as the raw material containing the ethyleneoxide adduct of bisphenol A as a main constitutional unit thereof which is contained in the shell. Therefore, it is considered that even in the step of coalescing the aggregated particles by heating upon production of the toner, compatibilization between these polyesters can be suppressed. As a result, it is considered that the toner maintains its core-shell structure and therefore can be improved in heat-resistant storage stability. In consequence, since the softening point and glass transition temperature of the resin constituting the core portion can be set to a low temperature, it is considered that while improving a low-temperature fusing property of the toner, a good heat-resistant storage stability can also be simultaneously imparted to the toner.

Further, the composite resin in the core portion is more hydrophobic than the polyester resin (b) in the shell portion. Therefore, the aggregated particles (1) forming the core portion which are surrounded with the resin is more stabilized than those particles surrounded with water. For this reason, when adding the resin particles (Y) containing the polyester resin (b) forming the shell portion to the aggregated particles (1) forming the core portion upon production of the toner, the resin particles (Y) forming the shell portion are likely to be adhered around the aggregated particles (1) forming the core portion. Moreover, in association with the aforementioned non-compatibility between the core and shell portions, the shell is likely to be uniformly formed on any of the aggregated particles forming the core, so that it becomes possible to produce a toner having a homogeneous shell layer. As a result, it is considered that the toner is improved in charge distribution and develop ability (dot reproducibility) which tend to be adversely affected by the composition and condition on a surface of the toner.

<Step (1)>

In the step (1), the resin particles (X) containing the composite resin that contains the segment constituted of the polyester resin (a) obtained by polycondensing the alcohol component containing 80 mol % or more of the propyleneoxide adduct of bisphenol A and the polycarboxylic acid component, and the vinyl-based resin segment containing a constitutional unit derived from the styrene-based compound, are aggregated in the aqueous medium to obtain the aggregated particles (1).

Meanwhile, the step of aggregating the resin particles (X) to obtain the aggregated particles (1) is hereinafter also referred to as merely an "aggregating step (1)".

(Resin Particles (X))

The resin particles (X) are resin particles constituting the core portion of the toner obtained by the production process of the present invention, and contain the composite resin.

[Composite Resin]

The composite resin contains the segment constituted of the polyester resin (a) obtained by polycondensing the alcohol component containing 80 mol % or more of the propyleneoxide adduct of bisphenol A and the polycarboxylic acid component, and the vinyl-based resin segment containing a constitutional unit derived from the styrene-based compound.

The content of the composite resin in the resin component constituting the resin particles (X) is preferably not less than 80% by mass, more preferably not less than 90% by mass, still more preferably not less than 95% by mass, even still more preferably not less than 98% by mass, and further even still more preferably 100% by mass, from the viewpoint of improving a low-temperature fusing property of the toner.

{Polyester Segment}

The polyester segment is constituted of the polyester resin (a) obtained by polycondensing the alcohol component containing 80 mol % or more of the propyleneoxide adduct of bisphenol A (hereinafter also referred to as an "alcohol component (a-al)") and the polycarboxylic acid component (hereinafter also referred to as a "polycarboxylic acid component (a-ac)"), from the viewpoint of improving a low-temperature fusing property and a heat-resistant storage stability of the toner.

The polyester segment preferably contains an acid group at a terminal end of a molecular chain thereof, from the viewpoint of improving a dispersion stability of the resin particles (X) in the aqueous medium. Examples of the acid group include a carboxy group, a sulfonic group, a phosphonic group and a sulfinic group. Of these acid groups, preferred is a carboxy group from the viewpoint of improving a dispersion stability of the resin particles (X) in the aqueous medium.

<<Alcohol Component (a-al)>>

The alcohol component (a-al) contains 80 mol % or more of a propyleneoxide adduct of bisphenol A from the viewpoint of satisfying both of a good low-temperature fusing property and a good heat-resistant storage stability of the resulting toner.

When using the propyleneoxide adduct of bisphenol A in the alcohol component of the polyester segment, it is considered that the resulting composite resin of the core portion has a low compatibility with the polyester resin (b) of the shell portion, so that the toner can maintain a core-shell structure without causing excessive compatibilization of the core and shell portions at an interface therebetween.

The content of the propyleneoxide adduct of bisphenol A in the alcohol component (a-al) is preferably not less than 90 mol %, more preferably not less than 95 mol %, still more preferably not less than 98 mol %, and even still more preferably 100 mol %, from the viewpoint of satisfying both of a good low-temperature fusing property and a good heat-resistant storage stability of the resulting toner.

The average molar number of addition of propyleneoxide in the propyleneoxide adduct of bisphenol A is preferably not less than 1, more preferably not less than 1.2, and still more preferably not less than 1.5, and is also preferably not more than 16, more preferably not more than 12, still more preferably not more than 8, and even still more preferably not more than 4, from the viewpoint of satisfying both of a good low-temperature fusing property and a good heat-resistant storage stability of the resulting toner.

The alcohol component (a-al) may also contain an alcohol other than the propyleneoxide adduct of bisphenol A. Examples of the other alcohol which may be contained in the alcohol component (a-al) include aliphatic diols, aromatic diols, alicyclic diols, trivalent or higher-valent polyhydric alcohols, and $C_2$ to $C_4$ alkyleneoxide adducts of these alcohols (average molar number of addition of the alkyleneoxide; not less than 1 and not more than 16).

Specific examples of the other alcohol which may be contained in the alcohol component (a-al) include aliphatic diols such as ethylene glycol, 1,2-propanediol, 1,3-propanediol, 1,2-butanediol, 1,3-butanediol, 1,4-butanediol, 2,3-butanediol, neopentyl glycol, 1,4-butenediol, 1,5-pentanediol, 1,6-hexanediol, 1,8-octanediol, 1,9-nonanediol, 1,10-decanediol and 1,12-dodecanediol; aromatic diols such as bisphenol A or ethyleneoxide adducts thereof (average molar number of addition of ethyleneoxide: not less than 1 and not more than 16); alicyclic diols such as hydrogenated bisphenol A or $C_2$ to $C_4$ alkyleneoxide adducts thereof (average molar number of addition of the alkyleneoxide: not less than 2 and not more than 12); and trivalent or higher-valent polyhydric alcohols such as glycerol, pentaerythritol, trimethylolpropane and sorbitol or $C_2$ to $C_4$ alkyleneoxide adducts thereof (average molar number of addition of the alkyleneoxide: not less than 1 and not more than 16).

Of these other alcohols, preferred is an ethyleneoxide adduct of bisphenol A.

These other alcohols which may be contained in the alcohol component (a-al) may be used alone or in combination of any two or more thereof.

<<Polycarboxylic Acid Component (a-ac)>>

Examples of the polycarboxylic acid component (a-ac) include dicarboxylic acids, trivalent or higher-valent polycarboxylic acids, and anhydrides and $C_1$ to $C_3$ alkyl esters of these acids. Of these acids, preferred are dicarboxylic acids, and more preferred is combination of a dicarboxylic acid and a trivalent or higher-valent polycarboxylic acid.

Examples of the dicarboxylic acids include aromatic dicarboxylic acids, aliphatic dicarboxylic acids, and alicyclic dicarboxylic acids. Of these dicarboxylic acids, preferred are aromatic dicarboxylic acids and aliphatic dicarboxylic acids, and more preferred are aromatic dicarboxylic acids.

The polycarboxylic acid component (a-ac) may also include, in addition to the free acids, anhydrides and $C_1$ to $C_3$ alkyl esters of the carboxylic acids capable of producing an acid by decomposition thereof during the reaction.

Examples of the aromatic dicarboxylic acids include phthalic acid, isophthalic acid and terephthalic acid. Of these aromatic dicarboxylic acids, from the viewpoint of improving a heat-resistant storage stability of the resulting toner, preferred are isophthalic acid and terephthalic acid, and more preferred is terephthalic acid.

From the viewpoint of improving a low-temperature fusing property and a heat-resistant storage stability of the resulting toner, the aliphatic dicarboxylic acids preferably have not less than 2 and not more than 30 carbon atoms, and more preferably not less than 3 and not more than 20 carbon atoms.

Examples of the aliphatic dicarboxylic acids having not less than 2 and not more than 30 carbon atoms include oxalic acid, malonic acid, maleic acid, fumaric acid, citraconic acid, itaconic acid, glutaconic acid, succinic acid, adipic acid, sebacic acid, 1,12-dodecanedioic acid, azelaic acid, and succinic acids substituted with an alkyl group having not less than 1 and not more than 20 carbon atoms or an alkenyl group having not less than 2 and not more than 20 carbon atoms. Of these aliphatic dicarboxylic acids, from the viewpoint of improving a heat-resistant storage stability of the resulting toner, preferred are adipic acid, sebacic acid and fumaric acid, and more preferred are adipic acid and fumaric acid. Specific examples of the succinic acids substituted with an alkyl group having not less than 1 and not more than 20 carbon atoms or an alkenyl group having not less than 2 and not more than 20 carbon atoms include dodecyl succinic acid, dodecenyl succinic acid and octenyl succinic acid.

Of these acids, preferred is terephthalic acid, more preferred is combination of terephthalic acid with at least one compound selected from the group consisting of adipic acid, fumaric acid, dodecenyl succinic acid and anhydrides of these acids, and still more preferred is combination of terephthalic acid with adipic acid or fumaric acid.

Of the trivalent or higher-valent polycarboxylic acids, from the viewpoint of improving a low-temperature fusing property and a heat-resistant storage stability of the resulting toner, preferred are trimellitic acid and trimellitic anhydride, and more preferred is trimellitic anhydride.

These alcohol components (a-al) and the polycarboxylic acid components (a-ac) are respectively used alone or in combination of any two or more kinds thereof.

The equivalent ratio of the polycarboxylic acid component (a-ac) to the alcohol component (a-al) (COOH group/OH group) in the polyester segment is preferably not less than 0.7, more preferably not less than 0.8, and still more preferably not less than 0.9, and is also preferably not more than 1.3, more preferably not more than 1.2, and still more preferably not more than 1.1, from the viewpoints of improving a low-temperature fusing property and a heat-resistant storage stability of the resulting toner, and improving a dispersion stability of the resin particles (X) in the aqueous medium.

The content of the polyester segment in the composite resin is preferably not less than 40% by mass, more preferably not less than 45% by mass, and still more preferably not less than 55% by mass, from the viewpoint of improving a low-temperature fusing property of the resulting toner, and is also preferably not more than 90% by mass, more preferably not more than 85% by mass, and still more preferably not more than 75% by mass, from the viewpoint of improving a heat-resistant storage stability of the resulting toner.

[Vinyl-Based Resin Segment]

The vinyl-based resin segment contains a constitutional unit derived from the styrene-based compound, from the viewpoint of improving a low-temperature fusing property and a heat-resistant storage stability of the resulting toner.

By incorporating the constitutional unit derived from the styrene-based compound into the vinyl-based resin segment, the obtained composite resin constituting the core portion can be enhanced in hydrophobicity, and exhibit a reduced compatibility with the shell having a relatively high hydrophilicity. As a result, it is considered that the resulting toner can sufficiently maintain its core-shell structure.

In addition, the vinyl-based resin segment preferably contains a constitutional unit derived from a vinyl monomer other than the styrene-based compound.

<<Styrene-Based Compound>>

As the styrene-based compound, there may be mentioned substituted or unsubstituted styrene. Examples of the substituent group of the substituted styrene include an alkyl group having not less than 1 and not more than 5 carbon atoms, a halogen atom, an alkoxy group having not less than 1 and not more than 5 carbon atoms, a sulfonic group or a salt thereof, etc.

Examples of the preferred styrene-based compound include styrenes such as styrene, methyl styrene, α-methyl styrene, β-methyl styrene, t-butyl styrene, chlorostyrene, chloromethyl styrene, methoxystyrene, styrenesulfonic acid or a salt thereof, etc. Of these styrene compounds, preferred are those compounds containing styrene, and more preferred is styrene.

The content of the styrene-based compound in the vinyl monomer as the raw material from which the vinyl-based resin segment is derived is preferably not less than 50% by mass, more preferably not less than 60% by mass, and still more preferably not less than 70% by mass, and is also preferably not more than 95% by mass, more preferably not more than 90% by mass, and still more preferably not more than 85% by mass, from the viewpoint of improving a low-temperature fusing property and a heat-resistant storage stability of the resulting toner.

<<Vinyl Monomer other than Styrene-Based Compound>>

As the vinyl monomer other than the styrene-based compound, there may be mentioned at least one compound selected from the group consisting of (meth)acrylic acid esters such as $C_1$ to $C_{24}$ alkyl (meth)acrylates, benzyl (meth) acrylate and dimethylaminoethyl (meth)acrylate; olefins such as ethylene, propylene and butadiene; halovinyl compounds such as vinyl chloride; vinyl esters such as vinyl acetate and vinyl propionate; vinyl ethers such as vinyl methyl ether; halogenated vinylidenes such as vinylidene chloride; N-vinyl compounds such as N-vinyl pyrrolidone. Of these vinyl monomers other than the styrene-based compound, from the viewpoint of improving a low-temperature fusing property and a heat-resistant storage stability of the resulting toner, preferred are (meth)acrylic acid esters, and more preferred are $C_1$ to $C_{24}$ alkyl (meth)acrylates.

The number of carbon atoms of an alkyl group in the alkyl (meth)acrylates is preferably not less than 1, more preferably not less than 6, and still more preferably not less than 10, from the viewpoint of improving a low-temperature fusing property and a heat-resistant storage stability of the resulting toner, and is also preferably not more than 24, more preferably not more than 22, and still more preferably not more than 20, from the viewpoint of a good availability of the monomer.

Specific examples of the alkyl (meth)acrylates include methyl (meth)acrylate, ethyl (meth)acrylate, (iso)propyl (meth)acrylate, (iso- or tertiary-)butyl (meth)acrylate, (iso) amyl (meth)acrylate, cyclohexyl (meth)acrylate, 2-ethylhexyl (meth)acrylate, (iso)octyl (meth)acrylate, (iso)decyl (meth)acrylate, (iso)dodecyl (meth)acrylate, (iso)palmityl (meth)acrylate, (iso)stearyl (meth)acrylate and (iso)behenyl (meth)acrylate. Of these alkyl (meth)acrylates, preferred are 2-ethylhexyl acrylate or stearyl methacrylate, and more preferred is stearyl methacrylate.

Meanwhile, the terms "(iso- or tertiary-)" and "(iso)" as used herein mean both the structure in which the groups expressed by "(iso- or tertiary-)" and "(iso)" are present, and the structure in which these groups are not present (i.e., normal), and the "(meth)acrylate" means an acrylate or a methacrylate.

Of these compounds, from the viewpoints of attaining a good availability of the monomer and improving a low-temperature fusing property and a heat-resistant storage stability of the resulting toner, preferred is styrene solely or combination of styrene with the (meth)acrylic acid ester, more preferred is combination of styrene with the (meth) acrylic acid ester, and still more preferred is combination of styrene with the alkyl (meth)acrylate containing an alkyl group having not less than 10 and not more than 20 carbon atoms.

The content of the vinyl monomer other than the styrene-based compound in the vinyl monomer as the raw material from which the vinyl-based resin segment is derived is preferably not less than 5% by mass, more preferably not less than 10% by mass, and still more preferably not less than 15% by mass, and is also preferably not more than 50% by mass, more preferably not more than 40% by mass, and still more preferably not more than 30% by mass, from the viewpoint of improving a low-temperature fusing property and a heat-resistant storage stability of the resulting toner.

A total content of the styrene-based compound and the (meth)acrylic acid ester in the vinyl monomer as the raw material from which the vinyl-based resin segment is derived, is preferably not less than 80% by mass, more preferably not less than 90% by mass, still more preferably not less than 95% by mass, and even still more preferably 100% by mass, from the viewpoint of improving a low-temperature fusing property and a heat-resistant storage stability of the resulting toner.

<<Bireactive Monomer>>

When using a bireactive monomer as the raw material monomer for the composite resin, the bireactive monomer is reacted with both the polyester segment and the vinyl-based resin segment to produce the composite resin. More specifically, it is preferred that the composite resin used in the present invention contains the vinyl-based resin segment containing a constitutional unit derived from the bireactive monomer, and it is also preferred that the constitutional unit derived from the bireactive monomer acts as a bonding point between the vinyl-based resin segment and the polyester segment.

As the bireactive monomer, there may be used those vinyl monomers containing at least one functional group selected from the group consisting of a hydroxy group, a carboxy group, an epoxy group, a primary amino group and a secondary amino group in a molecule thereof. Of these vinyl monomers, from the viewpoint of a reactivity, preferred are vinyl monomers containing a hydroxy group and/or a carboxy group, and more preferred are vinyl monomers containing a carboxy group. Specific examples of the vinyl monomers containing a carboxy group include acrylic acid, methacrylic acid, fumaric acid and maleic acid. Of these vinyl monomers, from the viewpoint of a reactivity of both the polycondensation reaction and addition polymerization reaction, preferred is at least one acid selected from the group consisting of acrylic acid and methacrylic acid, and more preferred is acrylic acid.

From the viewpoints of attaining a good dispersibility of the addition polymer containing the styrene-based compound as a constitutional unit thereof in the polyester resin and well controlling the addition polymerization reaction and polycondensation reaction, the bireactive monomer is preferably used in an amount of not less than 1 mole part, more preferably not less than 5 mole parts, still more preferably not less than 10 mole parts, and even still more preferably not less than 13 mole parts, and also preferably not more than 30 mole parts, more preferably not more than 25 mole parts, and still more preferably not more than 20 mole parts, on the basis of 100 mole parts of a total amount of the alcohol component (a-al) as the raw material of the polyester segment.

The content of the vinyl-based resin segment in the composite resin is preferably not less than 10% by mass, more preferably not less than 15% by mass, and still more preferably not less than 25% by mass, from the viewpoint of improving a low-temperature fusing property and a heat-resistant storage stability of the resulting toner, and is also preferably not more than 60% by mass, more preferably not more than 55% by mass, and still more preferably not more than 45% by mass, from the viewpoint of improving a low-temperature fusing property of the resulting toner.

The total content of the polyester segment and the vinyl-based resin segment in the composite resin is preferably not less than 80% by mass, more preferably not less than 90% by mass, still more preferably not less than 95% by mass, and even still more preferably 100% by mass, from the viewpoint of improving a low-temperature fusing property and a heat-resistant storage stability of the resulting toner.

The softening point of the composite resin is preferably not lower than 70° C., more preferably not lower than 75° C., still more preferably not lower than 80° C., and even still more preferably not lower than 85° C., from the viewpoint of improving a heat-resistant storage stability of the resulting toner, and is also preferably not higher than 165° C., more preferably not higher than 140° C., still more preferably not higher than 120° C., and even still more preferably not higher than 110° C., from the viewpoint of improving a low-temperature fusing property of the resulting toner.

The glass transition temperature of the composite resin is preferably not lower than 30° C., more preferably not lower than 35° C., and still more preferably not lower than 40° C., from the viewpoint of improving a heat-resistant storage stability of the resulting toner, and is also preferably not higher than 60° C., more preferably not higher than 55° C., still more preferably lower than 55° C., even still more preferably not higher than 50° C., further even still more preferably not higher than 47° C., and further even still more preferably not higher than 45° C., from the viewpoint of improving a low-temperature fusing property of the resulting toner.

The acid value of the composite resin is preferably not less than 5 mgKOH/g, more preferably not less than 10 mgKOH/g, and still more preferably not less than 15 mgKOH/g, and is also preferably not more than 40 mgKOH/g, more preferably not more than 35 mgKOH/g, and still more preferably not more than 30 mgKOH/g, from the viewpoints of improving a dispersion stability of the resin particles (X) containing the composite resin in the aqueous medium, and improving a heat-resistant storage stability of the resulting toner.

The composite resin may be used alone or in combination of any two or more kinds thereof.

Meanwhile, when the composite resin is used in the form of a mixture of two or more kinds of composite resins, the softening point, the glass transition temperature and the acid value of the composite resin respectively mean a softening point, a glass transition temperature and an acid value of the mixture as measured by the methods described in Examples below.

In addition, as described later, when using such a composite resin as produced in the presence of the wax, it may be difficult to measure a softening point, a glass transition temperature and an acid value of the composite resin solely. Therefore, in such a case, the softening point, the glass transition temperature and the acid value of the composite resin respectively mean a softening point, a glass transition temperature and an acid value of a mixture containing the composite resin and the wax as measured by the methods described in Examples below.

{Production of Composite Resin}

The composite resin is preferably produced by any of the following methods (i) to (iii). Meanwhile, the bireactive monomer is preferably supplied together with the raw material monomer for the vinyl-based resin component to the reaction system, from the viewpoint of a reactivity. In addition, from the viewpoint of a reactivity, there may be used a catalyst such as an esterification catalyst and an esterification co-catalyst. Further, there may also be used a polymerization initiator and a polymerization inhibitor.

(i) Method in which the step of the polycondensation reaction between the alcohol component and the polycarboxylic acid component (hereinafter also referred to as a "step (A)") is followed by the step of an addition polymerization reaction of the raw material monomer for the vinyl-based resin component and, if required, the bireactive monomer (hereinafter also referred to as a "step (B)").

Meanwhile, there is more preferably used the method in which after subjecting a part of the polycarboxylic acid component to the polycondensation reaction in the step (A) and then conducting the step (B), the reaction temperature is raised again, and a remaining part of the polycarboxylic acid component is added to the polymerization reaction system to allow the polycondensation reaction in the step (A) and, if required, the reaction with the bireactive monomer to further proceed.

(ii) Method in which the step (B) of the addition polymerization reaction of the raw material monomer for the vinyl-based resin component and the bireactive monomer is followed by the step (A) of the polycondensation reaction of the raw material monomer for the polyester resin component.

In this method, the alcohol component and the polycarboxylic acid component may be allowed to be present in the reaction system in advance upon the addition polymerization reaction, followed by adding the esterification catalyst, if required, together with the esterification co-catalyst, to the reaction system at a temperature suitable for the polycondensation reaction to initiate the polycondensation reaction, or the alcohol component and the polycarboxylic acid component may be subsequently added to the reaction system under the temperature conditions suitable for the polycondensation reaction to initiate the polycondensation reaction. In the former case, by adding the esterification catalyst, if required, together with the esterification co-catalyst, to the reaction system at a temperature suitable for the polycondensation reaction, it is possible to well control a molecular weight and a molecular weight distribution of the resulting polymer.

(iii) Method in which the step (A) of the polycondensation reaction of the alcohol component and the polycarboxylic acid component and the step (B) of the addition polymerization reaction of the raw material monomer for the vinyl-based resin component and the bireactive monomer are conducted in parallel with each other.

In this method, it is preferred that the step (A) and the step (B) are conducted under the reaction temperature conditions suitable for the addition polymerization reaction, and then the reaction temperature is raised until the temperature conditions suitable for the polycondensation reaction, under which the polycondensation reaction as the step (A) is further conducted, if required, by adding a trivalent or higher-valent raw material monomer for the polyester resin component, etc., as a crosslinking agent, to the polymerization reaction system. In such a case, under the temperature conditions suitable for the polycondensation reaction, it is possible to allow the polycondensation reaction only to proceed by adding a radical polymerization inhibitor to the reaction system. The bireactive monomer is concerned in not only the addition polymerization reaction but also the polycondensation reaction.

Of these methods, the method (i) is preferred because the polycondensation reaction temperature can be selected with a high degree of freedom. The aforementioned methods (i) to (iii) are preferably conducted in the same vessel.

The temperature used in the addition polymerization reaction may vary depending upon the kind of polymerization initiator used, and is preferably not lower than 110° C., more preferably not lower than 130° C., and still more preferably not lower than 150° C., and is also preferably not higher than 220° C., more preferably not higher than 200° C., and still more preferably not higher than 180° C., from the viewpoint of a high productivity of the composite resin.

The temperature used in the polycondensation reaction is preferably not lower than 120° C., more preferably not lower than 140° C., still more preferably not lower than 180° C., and even still more preferably not lower than 200° C., and is also preferably not higher than 260° C., more preferably not higher than 250° C., still more preferably not higher than 245° C., and even still more preferably not higher than 240° C., from the viewpoint of a high productivity of the composite resin.

Also, the reaction system may be held under reduced pressure in a later stage of the polymerization step to promote the reaction.

<<Esterification Catalyst>>

Examples of the esterification catalyst suitably used in the polycondensation reaction include tin compounds such as dibutyl tin oxide and tin (II) di(2-ethyl hexanoate), and titanium compounds such as titanium diisopropylate bistriethanol aminate.

The amount of the esterification catalyst used is not particularly limited, and is preferably not less than 0.01 part by mass, more preferably not less than 0.1 part by mass, and still more preferably not less than 0.3 part by mass, and is also preferably not more than 5 parts by mass, more preferably not more than 2 parts by mass, and still more preferably not more than 1 part by mass, on the basis of 100 parts by mass of a total amount of the alcohol component (a-al) and the polycarboxylic acid component (a-ac).

<<Esterification Co-Catalyst>>

Examples of the esterification co-catalyst include pyrogallol compounds such as pyrogallol, gallic acid, gallic acid esters; benzophenone derivatives such as 2,3,4-trihydroxybenzophenone and 2,2',3,4-tetrahydroxybenzophenone; and catechin derivatives such as epigallocatechin and epigallocatechin gallate. Of these esterification co-catalysts, gallic acid is preferred from the viewpoint of a high reactivity.

The amount of the esterification co-catalyst used in the polycondensation reaction is preferably not less than 0.001 part by mass, more preferably not less than 0.01 part by mass, and still more preferably not less than 0.03 part by mass, and is also preferably not more than 0.5 part by mass, more preferably not more than 0.2 part by mass, and still more preferably not more than 0.1 part by mass, on the basis of 100 parts by mass of a total amount of the alcohol component (a-al) and the polycarboxylic acid component (a-ac).

The resin particles (X) preferably contain the composite resin and the wax.

In the present invention, the wax is preferably incorporated into the core portion of the toner from the viewpoint of suppressing desorption thereof from the toner. As the method of incorporating the wax into the core portion of the toner, there may be mentioned a method of mixing the wax in the composite resin upon synthesis or emulsification of the composite resin to incorporate the composite resin and the wax into the resin particles (X), and a method of mixing the resin particles (X) and the wax particles in the aggregating step (1) to incorporate the composite resin and the wax into the resulting aggregated particles. Of these methods, from the viewpoint of improving a heat-resistant storage stability of the resulting toner, preferred is the method of incorporating the composite resin and the wax into the resin particles (X).

Further, it is considered that by introducing the resin particles (X) containing the composite resin and the wax into the core portion of the toner obtained by the production process of the present invention, and applying the shell-forming resin particles (Y) having a low compatibility with the core portion onto the core portion, it is possible to prevent isolation of the wax into water as well as exposure of the wax onto a surface of the toner, in the subsequent aggregating step and coalescing step, and suppress occurrence of toner cloud.

[Wax]

As the wax, there may be used an ester-based wax, a hydrocarbon wax, a silicone wax, a fatty acid amide, etc. Of these waxes, from the viewpoint of improving a low-temperature fusing property and a heat-resistant storage stability of the resulting toner, preferred is the hydrocarbon wax.

Examples of the hydrocarbon wax include low-molecular weight polyolefins such as polyethylene, polypropylene and polybutene; and mineral and petroleum-based waxes such as ozokerite, ceresin, paraffin wax, microcrystalline wax and Fischer-Tropsch wax. Of these hydrocarbon waxes, from the viewpoint of improving a low-temperature fusing property and a heat-resistant storage stability of the resulting toner, preferred is the paraffin wax.

Examples of the ester-based wax include esters obtained from a long-chain alcohol and a fatty acid, such as stearyl stearate and behenyl behenate; esters obtained from pentaerythritol and a fatty acid such as behenic acid; and natural waxes such as carnauba wax, rice wax, montan wax and beeswax. Of these ester-based waxes, from the viewpoint of improving a low-temperature fusing property and a heat-resistant storage stability of the resulting toner, preferred are the esters obtained from pentaerythritol and a fatty acid such as behenic acid.

The melting point of the wax is preferably not lower than 60° C., more preferably not lower than 65° C., and still more preferably not lower than 70° C., and is also preferably not higher than 100° C., more preferably not higher than 90° C., and still more preferably not higher than 85° C., from the viewpoint of improving a low-temperature fusing property and a heat-resistant storage stability of the resulting toner.

The content of the wax is preferably not less than 2 parts by mass, more preferably not less than 5 parts by mass, and still more preferably not less than 8 parts by mass, and is also preferably not more than 30 parts by mass, more preferably not more than 20 parts by mass, and still more preferably not more than 15 parts by mass, on the basis of 100 parts by mass of the composite resin, from the viewpoint of improving a releasing property and a low-temperature fusing property of the resulting toner.

The content of the resin component in the resin particles (X) is preferably not less than 67% by mass, more preferably not less than 77% by mass, and still more preferably not less than 87% by mass, and is also preferably not more than 95% by mass, and more preferably not more than 93% by mass, from the viewpoint of improving a low-temperature fusing property of the resulting toner.

As the resins constituting the resin particles (X), in addition to the composite resin, there may also be used known resins ordinarily used for toners, for example, a polyester, a styrene-acrylic copolymer, an epoxy resin, a polycarbonate, a polyurethane, etc.

The resin particles (X) may also contain a colorant and a charge control agent unless the effects of the present invention are adversely influenced by addition thereof. Further, the resin particles (X) may also contain other additives such as a reinforcing filler such as fibrous substances, an antioxidant and an anti-aging agent, if required.

[Production of Resin Particles (X)]

The resin particles (X) are preferably produced by the method of dispersing the resin component containing the composite resin together with the aforementioned optional components such as a wax and a colorant in an aqueous medium to obtain an aqueous dispersion containing the resin particles (X).

As the method of obtaining the aqueous dispersion containing the resin particles (X), there may be used a method of adding the composite resin and the like to the aqueous medium and subjecting the resulting mixture to dispersing treatment using a disperser, etc., a method of gradually adding the aqueous medium to the composite resin and the like to subject the resulting mixture to phase inversion emulsification, etc. Among these methods, from the viewpoint of improving a low-temperature fusing property of the resulting toner, the method using phase inversion emulsification is preferred.

{Aqueous Medium}

The aqueous medium used for producing the resin particles (X) preferably contains water as a main component. From the viewpoints of improving a dispersion stability of an aqueous dispersion of the resin particles (X) and attaining a good environmental suitability, the content of water in the aqueous medium is preferably not less than 80% by mass, more preferably not less than 90% by mass, still more preferably not less than 95% by mass, even still more preferably not less than 98% by mass, and further even still more preferably 100% by mass. As the water, deionized water or distilled water is preferably used.

Examples of components other than water which may be contained in the aqueous medium include water-soluble organic solvents, e.g., alkyl alcohols having not less than 1 and not more than 5 carbon atoms; dialkyl ketones having not less than 3 and not more than 5 carbon atoms, such as acetone and methyl ethyl ketone; and cyclic ethers such as tetrahydrofuran. Of these organic solvents, from the viewpoint of preventing inclusion of the organic solvents into the resulting toner, preferred are alkyl alcohols having not less than 1 and not more than 5 carbon atoms which are incapable of dissolving the polyester therein, and more preferred are methanol, ethanol, isopropanol and butanol.

In the following, the method using phase inversion emulsification is explained.

As the method of performing the phase inversion emulsification, there may be mentioned a method of adding the aqueous medium to a solution prepared by dissolving the composite resin and the aforementioned other optional components in an organic solvent to subject the solution to phase inversion emulsification (hereinafter also referred to merely as a "method (1-1)", and a method of adding the aqueous medium to a resin mixture prepared by melting and mixing the composite resin and the aforementioned other optional components to subject the resin mixture to phase inversion emulsification (hereinafter also referred to merely as a "method (1-2)". Of these methods, from the viewpoint of obtaining a aqueous dispersion of the uniform resin particles (X), preferred is the method (1-1).

In the method (1-1), the composite resin and the aforementioned other optional components are first dissolved in an organic solvent to prepare an organic solvent solution of a mixture containing the composite resin and the other optional components, and then the aqueous medium is added to the thus obtained solution to subject the solution to phase inversion emulsification.

{Organic Solvent}

The organic solvent used above preferably has a solubility parameter (SP value: "Polymer Handbook, Third Edition", published in 1989 by John Wiley & Sons, Inc.) of not less than 15.0 $MPa^{1/2}$, more preferably not less than 16.0 $MPa^{1/2}$, and still more preferably not less than 17.0 $MPa^{1/2}$, and also preferably not more than 26.0 $MPa^{1/2}$, more preferably not more than 24.0 $MPa^{1/2}$, and still more preferably not more than 22.0 $MPa^{1/2}$, from the viewpoint of facilitating dissolution of the composite resin and phase inversion thereof into the aqueous medium.

Specific examples of the organic solvent used above are as follows. Meanwhile, the numeral values in parentheses after the names of the following organic solvents respectively indicate SP values thereof, and a unit of the SP values is $MPa^{1/2}$. That is, specific examples of the organic solvent include alcohol solvents such as ethanol (26.0), isopropanol (23.5) and isobutanol (21.5); ketone solvents such as acetone (20.3), methyl ethyl ketone (19.0), methyl isobutyl ketone (17.2) and diethyl ketone (18.0); ether solvents such as dibutyl ether (16.5), tetrahydrofuran (18.6) and dioxane (20.5); and acetic acid ester solvents such as ethyl acetate (18.6) and isopropyl acetate (17.4). Of these organic solvents, from the viewpoint of facilitated removal of the organic solvents from the mixed solution obtained after adding the aqueous medium thereto, preferred is at least one solvent selected from the group consisting of ketone solvents and acetic acid ester solvents, more preferred is at least one solvent selected from the group consisting of methyl ethyl ketone, ethyl acetate and isopropyl acetate, and still more preferred is methyl ethyl ketone.

The mass ratio of the organic solvent to the constituents of the resin particles (X) including the composite resin and the optional components such as the wax (hereinafter also referred to merely as "constituents of the resin particles (X)") (organic solvent/constituents of the resin particles (X)) is preferably not less than 0.1, more preferably not less than 0.2, and still more preferably not less than 0.25, and is also preferably not more than 4, more preferably not more than 3, still more preferably not more than 1, and even still more preferably not more than 0.5, from the viewpoint of facilitating dissolution of the composite resin and phase inversion thereof into the aqueous medium.

In the method (1-1), it is preferable to add a neutralizing agent to the solution. As the neutralizing agent, there may be used a basic substance. Examples of the basic substance include hydroxides of alkali metals such as lithium hydroxide, sodium hydroxide and potassium hydroxide; and nitrogen-containing basic substances such as ammonia, trimethyl amine, ethyl amine, diethyl amine, triethyl amine, diethanol amine, triethanol amine and tributyl amine. Of these basic substances, from the viewpoint of improving a dispersion stability and an aggregating property of the resin particles (X), preferred are hydroxides of alkali metals, and more preferred is sodium hydroxide.

The degree (mol %) of neutralization of the composite resin with the neutralizing agent is preferably not less than 10 mol %, and more preferably not less than 30 mol %, and is also preferably not more than 150 mol %, more preferably not more than 120 mol %, and still more preferably not more than 100 mol %.

Meanwhile, the degree (mol %) of neutralization of the composite resin may be determined according to the following formula. When the composite resin used above is produced in the presence of the wax, the acid value of the composite resin as denoted in the following formula means an acid value of a mixture containing the composite resin and the wax.

Degree of neutralization={[mass (g) of neutralizing agent added/equivalent of neutralizing agent]/[(acid value of composite resin (mgKOH/g)× mass (g) of the resin)/(56×1000)]}×100.

The amount of the aqueous medium added is preferably not less than 100 parts by mass, more preferably not less than 150 parts by mass, and still more preferably not less than 200 parts by mass, and is also preferably not more than 900 parts by mass, more preferably not more than 600 parts by mass, and still more preferably not more than 400 parts by mass, on the basis of 100 parts by mass of the constituents of the resin particles (X), from the viewpoints of improving a dispersion stability of the resin particles (X) and obtaining uniform aggregated particles in the subsequent aggregating step.

In addition, from the viewpoint of improving a dispersion stability of the resin particles (X), the mass ratio of the aqueous medium to the organic solvent (aqueous medium/organic solvent) is preferably not less than 20/80, more preferably not less than 33/67, still more preferably not less than 50/50, even still more preferably not less than 67/33, and further even still more preferably not less than 80/20, and is also preferably not more than 99/1, more preferably not more than 95/5, still more preferably not more than 93/7, and even still more preferably not more than 92/8.

The temperature used upon adding the aqueous medium is preferably not lower than a glass transition temperature of the resin, from the viewpoint of improving a dispersion stability of the resin particles (X). More specifically, the temperature used upon adding the aqueous medium is preferably not lower than 30° C., more preferably not lower than 50° C., and still more preferably not lower than 60° C., and is also preferably not higher than 85° C., more preferably not higher than 80° C., and still more preferably not higher than 75° C., from the viewpoint of improving a dispersion stability of the resin particles (X).

From the viewpoint of obtaining the resin particles (X) having a small particle size, the velocity of addition of the aqueous medium until terminating the phase inversion is preferably not less than 0.1 part by mass/min, more preferably not less than 0.5 part by mass/min, still more preferably not less than 1 part by mass/min, and even still more preferably not less than 5 parts by mass/min, and is also preferably not more than 50 parts by mass/min, more preferably not more than 30 parts by mass/min, still more preferably not more than 20 parts by mass/min, and even still more preferably not more than 10 parts by mass/min, on the basis of 100 parts by mass of the constituents of the resin particles (X).

The velocity of addition of the aqueous medium after terminating the phase inversion is not particularly limited.

After completion of the phase inversion emulsification, the step of removing the organic solvent from the dispersion obtained in the phase inversion emulsification may be conducted, if required.

The method of removing the organic solvent is not particularly limited, and an optional method may be used to remove the organic solvent therefrom.

Since the organic solvent is dissolved in water, the dispersion is preferably subjected to distillation to remove the organic solvent therefrom. In addition, it is not necessarily required to completely remove the organic solvent from the aqueous dispersion, and a small amount of the organic solvent may remain in the aqueous dispersion. In this case, the amount of the organic solvent remaining in the aqueous dispersion is preferably not more than 1% by mass, more preferably not more than 0.5% by mass, and still more preferably substantially 0%.

When removing the organic solvent by distillation, the dispersion is preferably heated to a temperature not lower than a boiling point of the organic solvent used while stirring to thereby distil off the organic solvent therefrom. In addition, from the viewpoint of maintaining a good dispersion stability of the resin particles (X), the dispersion is more preferably heated under reduced pressure to a temperature not lower than a boiling point of the organic solvent used under the reduced pressure to distil off the organic solvent therefrom. Meanwhile, the dispersion may be heated after reducing the pressure, or may be held under reduced pressure after heating. From the viewpoint of maintaining a good dispersion stability of the resin particles (X), the organic solvent is preferably distilled off from the dispersion under constant temperature and constant pressure conditions.

The solid content of the resulting aqueous dispersion of the resin particles (X) is preferably not less than 5% by mass, more preferably not less than 10% by mass, and still more preferably not less than 15% by mass, and is also preferably not more than 50% by mass, more preferably not more than 40% by mass, still more preferably not more than 30% by mass, and even still more preferably not more than 25% by mass, from the viewpoints of enhancing a productivity of the toner and improving a dispersion stability of the aqueous dispersion of the resin particles (X).

Meanwhile, the solid content means a total content of non-volatile components including resins, colorants, surfactants and the like.

The volume median particle size ($D_{50}$) of the resin particles (X) in the aqueous dispersion is preferably not less than 0.10 μm, more preferably not less than 0.15 μm, still more preferably not less than 0.20 μm, and even still more preferably not less than 0.35 μm, and is also preferably not more than 0.80 μm, more preferably not more than 0.70 μm, and still more preferably not more than 0.60 μm, from the viewpoint of obtaining a toner capable of forming a high quality image. Meanwhile, the volume median particle size as used herein means a particle size at which a cumulative volume frequency calculated on the basis of a volume fraction of the particles from a smaller particle size side thereof is 50%, and may be determined by the method described in Examples below.

The coefficient of variation of particle size distribution (CV: %) of the resin particles (X) is preferably not less than 5%, more preferably not less than 20%, and still more preferably not less than 28%, from the viewpoint of enhancing a productivity of the aqueous dispersion of the resin particles (X), and is also preferably not more than 50%, more preferably not more than 45%, and still more preferably not more than 40%, from the viewpoint of obtaining a toner capable of forming a high quality image.

Meanwhile, the CV as used herein means the value represented by the following formula. The volume-average particle size as denoted in the following formula means a particle size that is obtained by multiplying a particle size measured on the volume basis by a proportion of particles having the particle size, and then dividing the resulting value by the number of the particles. More specifically, the volume-average particle size may be determined by the method described in Examples below.

$$CV\ (\%)=[\text{Standard Deviation of Particle Size Distribution (nm)}/\text{Volume-Average Particle Size (nm)}]\times 100.$$

(Production of Aggregated Particles (1))

The aggregated particles (1) may be suitably produced by the method in which the aqueous dispersion of the resin particles (X) are aggregated in an aqueous medium, if required, together with optional components such as an aggregating agent, a surfactant and a colorant, and further, if required, together with a dispersion of wax particles in the case where the resin particles (X) contain no wax, to thereby obtain the aggregated particles as aimed.

In the above step, it is preferred that the aqueous dispersion of the resin particles (X) are first mixed in an aqueous medium, if required, together with a colorant, a surfactant or the like which may be optionally added thereto, to obtain a mixed dispersion. Meanwhile, if the resin particles (X) contain no colorant, it is preferred that a colorant is mixed in the mixed dispersion.

The mixed dispersion may also be mixed with resin particles other than the resin particles (X).

The order of mixing of the respective components is not particularly limited, and these components may be added in any order or may be added at the same time.

[Colorant]

In the toner obtained by the production process of the present invention, a colorant may be incorporated into either the core portion or shell portion thereof. From the viewpoint of improving a heat-resistant storage stability of the resulting toner, the colorant is preferably incorporated into the core portion.

The content of the colorant in the toner is preferably not less than 1 part by mass, and more preferably not less than 5 parts by mass, on the basis of 100 parts by mass of the resin component constituting the resin particles (X), from the viewpoint of enhancing an optical density of printed images, and is also preferably not more than 20 parts by mass, and more preferably not more than 10 parts by mass, on the basis of 100 parts by mass of the resin component constituting the resin particles (X), from the viewpoint of improving a low-temperature fusing property of the resulting toner.

Examples of the colorant used in the present invention include a pigment and a dye. Of these colorants, from the viewpoint of enhancing an optical density of printed images, the pigment is preferably used.

Examples of the pigment include a cyan pigment, a yellow pigment, a magenta pigment and a black pigment.

Preferred examples of the cyan pigment include a phthalocyanine pigment, and more preferred is copper phthalocyanine. Preferred examples of the yellow pigment include a monoazo pigment, an isoindoline pigment and a benzimidazolone pigment. Preferred examples of the magenta pigment include a quinacridone pigment, a soluble azo pigment such as a BONA lake pigment, and an insoluble azo pigment such as a naphthol AS pigment. Preferred examples of the black pigment include carbon blacks.

Examples of the dye include acridine dyes, azo dyes, benzoquinone dyes, azine dyes, anthraquinone dyes, indigo dyes, phthalocyanine dyes and Aniline Black dyes.

These colorants may be used alone or in combination of any two or more thereof.

In the case where the colorant is mixed in the mixed dispersion, it is preferred that the colorant is dispersed in an aqueous medium to obtain a dispersion of colorant particles (hereinafter also referred to as a "colorant particle dispersion").

The colorant particle dispersion is preferably obtained by dispersing the colorant and the aqueous medium in the presence of a surfactant, etc., using a disperser. Examples of the preferred disperser used above include a homogenizer and an ultrasonic disperser.

The preferred forms of the aqueous medium used in the above production step are the same as those of the aqueous medium used upon production of the above aqueous dispersion of the resin particles (X).

The colorant particles are preferably dispersed in the aqueous medium in the presence of a surfactant, from the viewpoint of improving a dispersion stability of the colorant particles.

Examples of the surfactant used for production of the colorant particles include a nonionic surfactant, an anionic surfactant, a cationic surfactant. etc. Of these surfactants, preferred is the anionic surfactant, from the viewpoints of improving a dispersion stability of the colorant particles and improving an aggregating property of the colorant particles and the resin particles (X). Specific examples of the anionic surfactant include sodium dodecylbenzenesulfonate, sodium dodecylsulfate, sodium laurylethersulfate and dipotassium alkenyl succinates. Of these anionic surfactants, preferred is sodium dodecylbenzenesulfonate.

The content of the surfactant in the colorant particle dispersion is preferably not less than 0.1% by mass, more preferably not less than 0.5% by mass, and still more preferably not less than 1.0% by mass, and is also preferably not more than 5.0% by mass, and more preferably not more than 4.5% by mass, from the viewpoints of improving a dispersion stability of the colorant particles and improving an aggregating property of the colorant particles and preventing isolation of the colorant particles from the resulting aggregated particles upon production of the toner.

The solid content of the colorant particle dispersion is preferably not less than 5% by mass, more preferably not less than 10% by mass, and still more preferably not less than 15% by mass, and is also preferably not more than 50% by mass, more preferably not more than 40% by mass, and still more preferably not more than 30% by mass, from the viewpoints of enhancing a productivity of the toner and improving a dispersion stability of the colorant particle dispersion.

The volume median particle size (D50) of the colorant particles is preferably not less than 50 nm, more preferably not less than 80 nm, and still more preferably not less than 100 nm, and is also preferably not more than 500 nm, more preferably not more than 300 nm, and still more preferably not more than 150 nm, from the viewpoint of obtaining a toner capable of forming a high quality image.

In the step (1), in particular, in the case where no wax is added upon production of the resin particles (X), the wax particles may be aggregated therewith in the aggregating step (1) to obtain the aggregated particles (1).

[Wax Particles]

The wax particles are preferably obtained in the form of a dispersion of the wax particles which is prepared by dispersing the wax in an aqueous medium (hereinafter also referred to as a "wax particle dispersion").

The wax used for producing the wax particles is the same as the wax that may be incorporated into the resin particles (X), and the preferred forms of the wax are also the same as those of the wax that may be incorporated into the resin particles (X).

The wax particle dispersion is preferably obtained by dispersing the wax and the aqueous medium in the presence of a surfactant, etc., at a temperature not lower than a melting point of the wax using a disperser. As the disperser, there are preferably used a homogenizer, an ultrasonic disperser, a high-pressure disperser, etc., from the viewpoint of satisfying both of a good low-temperature fusing property and a good heat-resistant storage stability of the resulting toner.

As the ultrasonic disperser, there may be used, for example, an ultrasonic homogenizer. Examples of commercially available devices of the ultrasonic homogenizer include "US-150T", "US-300T" and "US-600T" (all available from Nihonseiki Kaisha Ltd.), and "SONIFIER 4020-400" and "SONIFIER 4020-800" ("SONIFIER" is a registered trademark; both available from Branson Ultrasonics, Emerson Japan, Ltd.).

Examples of commercially available devices of the high-pressure disperser include a high-pressure wet-type atomizer "NANOMIZER (registered trademark) NM2-L200-D08" (available from Yoshida Kikai Co., Ltd.).

Further, it is preferred that before using the above disperser, the wax, surfactant and aqueous medium are previously dispersed using a mixer such as a homomixer and a ball mill.

The preferred forms of the aqueous medium used in the above production step are the same as those of the aqueous medium used upon obtaining the aqueous dispersion of the resin particles (X).

The wax particles are preferably dispersed in the aqueous medium in the presence of a surfactant, from the viewpoint of improving a dispersion stability of the wax particles and obtaining uniform aggregated particles in the subsequent aggregating step (1).

Examples of the surfactant used for production of the wax particles include a nonionic surfactant, an anionic surfactant, a cationic surfactant. etc. Of these surfactants, preferred is the anionic surfactant, from the viewpoints of improving a dispersion stability of the wax particles and improving an aggregating property of the wax particles and the resin particles. Specific examples of the anionic surfactant include sodium dodecylbenzenesulfonate, sodium dodecylsulfate, sodium laurylethersulfate and dipotassium alkenyl succinates. Of these anionic surfactants, preferred are dipotassium alkenyl succinates.

The content of the surfactant in the wax particle dispersion is preferably not less than 0.1% by mass, more preferably not less than 0.3% by mass, and still more preferably not less than 0.5% by mass, and is also preferably not more than 5.0% by mass, and more preferably not more than 2.0% by mass, from the viewpoints of improving a dispersion stability of the wax particles, improving an aggregating property of the wax particles, and preventing isolation of the wax particles from the resulting aggregated particles upon production of the toner.

The solid content of the wax particle dispersion is preferably not less than 5% by mass, more preferably not less than 10% by mass, and still more preferably not less than 15% by mass, and is also preferably not more than 50% by mass, more preferably not more than 30% by mass, and still more preferably not more than 25% by mass, from the viewpoints of enhancing a productivity of the toner and improving a dispersion stability of the wax particle dispersion.

The volume median particle size (D50) of the wax particles is preferably not less than 0.1 μm, more preferably not less than 0.2 μm, and still more preferably not less than 0.3 μm, and is also preferably not more than 1 μm, more preferably not more than 0.8 μm, and still more preferably not more than 0.6 μm, from the viewpoints of obtaining uniform aggregated particles in the subsequent aggregating step (1) and satisfying both of a good low-temperature fusing property and a good heat-resistant storage stability of the resulting toner.

The CV of the wax particles is preferably not less than 10%, and more preferably not less than 25%, from the viewpoint of enhancing a productivity of the toner, and is also preferably not more than 50%, more preferably not more than 45%, and still more preferably not more than 42%, from the viewpoints of obtaining uniform aggregated particles in the subsequent aggregating step (1) and improving a charging property of the resulting toner. The volume median particle size and CV of the wax particles may be concretely determined by the method described in Examples below.

The content of the resin particles (X) in the mixed dispersion is preferably not less than 5% by mass, more preferably not less than 10% by mass, and still more preferably not less than 15% by mass, from the viewpoint of satisfying both of a good low-temperature fusing property and a good heat-resistant storage stability of the resulting toner, and is also preferably not more than 40% by mass, more preferably not more than 30% by mass, and still more preferably not more than 25% by mass, from the viewpoint of well controlling the aggregation to obtain aggregated particles having a desired particle size.

The content of the aqueous medium in the mixed dispersion is preferably not less than 60% by mass, and more preferably not less than 70% by mass, from the viewpoint of well controlling the aggregation to obtain aggregated particles having a desired particle size, and is also preferably not more than 90% by mass, and more preferably not more than 85% by mass, from the viewpoint of enhancing a productivity of the toner.

The content of the colorant particles in the mixed dispersion is preferably not less than 1 part by mass, and more preferably not less than 3 parts by mass, and is also preferably not more than 20 parts by mass, and more preferably not more than 15 parts by mass, on the basis of 100 parts by mass of the resin particles (X), from the viewpoint of obtaining a toner capable of forming a high quality image.

When mixing the wax particles in the mixed dispersion, the content of the wax particles in mixed dispersion is preferably not less than 2 part by mass, more preferably not less than 5 parts by mass, and still more preferably not less than 8 parts by mass, on the basis of 100 parts by mass of the resin particles (X), from the viewpoints of improving a releasing property of the toner and satisfying both of a good low-temperature fusing property and a good heat-resistant storage stability of the resulting toner, and is also preferably not more than 30 parts by mass, more preferably not more than 20 parts by mass, and still more preferably not more than 15 parts by mass, on the basis of 100 parts by mass of the resin particles (X), from the viewpoint of improving a low-temperature fusing property of the resulting toner.

The temperature used upon the mixing is preferably not lower than 0° C., more preferably not lower than 10° C., and still more preferably not lower than 20° C., and is also preferably not higher than 40° C., and more preferably not higher than 30° C., from the viewpoint of well controlling the aggregation to obtain aggregated particles having a desired particle size.

Next, the particles in the mixed dispersion are aggregated together to obtain a dispersion of the aggregated particles (1). In this case, an aggregating agent is preferably added to the mixed dispersion, from the viewpoint of conducting aggregation of the particles in an efficient manner.

[Aggregating Agent]

The aggregating agent used in the present invention is preferably an electrolyte, and more preferably a salt, from the viewpoint of obtaining a toner having a desired particle size while preventing excessive aggregation thereof.

Examples of the aggregating agent include organic aggregating agents such as a cationic surfactant in the form of a quaternary salt and polyethyleneimine; and inorganic aggregating agents such as an inorganic metal salt, an inorganic ammonium salt and a divalent or higher-valent metal complex. Of these aggregating agents, from the viewpoint of improving an aggregating property of the particles to obtain uniform aggregated particles, preferred are inorganic aggregating agents, more preferred are an inorganic metal salt and an inorganic ammonium salt, and still more preferred is an inorganic ammonium salt.

The valence of the cation in the inorganic aggregating agents is preferably a pentavalence or lower, more preferably a divalence or lower, and still more preferably a monovalence, from the viewpoint of obtaining a toner having a desired particle size while preventing excessive aggregation thereof.

Examples of the monovalent cation in the inorganic aggregating agents include a sodium ion, a potassium ion and an ammonium ion. Of these monovalent cations, preferred is an ammonium ion, from the viewpoint of satisfying both of a good low-temperature fusing property and a good heat-resistant storage stability of the resulting toner.

Specific examples of the inorganic metal salt include metal salts such as sodium sulfate, sodium nitrate, sodium chloride, calcium chloride and calcium nitrate; and inorganic metal salt polymers such as poly(aluminum chloride) and poly(aluminum hydroxide).

Specific examples of the inorganic ammonium salt include ammonium sulfate, ammonium chloride and ammonium nitrate.

Among these aggregating agents, more preferred is ammonium sulfate.

The amount of the aggregating agent used is preferably not less than 5 parts by mass, more preferably not less than 10 parts by mass, and still more preferably not less than 20 parts by mass, on the basis of 100 parts by mass of the resins constituting the resin particles (X), from the viewpoint of well controlling the aggregation of the resin particles (X) to obtain aggregated particles having a desired particle size, and also is preferably not more than 50 parts by mass, more preferably not more than 45 parts by mass, and still more preferably not more than 40 parts by mass, on the basis of 100 parts by mass of the resins constituting the resin particles (X), from the viewpoint of satisfying both of a good low-temperature fusing property and a good heat-resistant storage stability of the resulting toner.

The aggregating agent is preferably added dropwise into the mixed dispersion. In this case, the aggregating agent may be added at one time, or intermittently or continuously. Upon and after adding the aggregating agent, the obtained dispersion is preferably fully stirred.

The aggregating agent to be added dropwise is preferably in the form of an aqueous solution, from the viewpoint of well controlling the aggregation to obtain aggregated particles having a desired particle size. The concentration of the aqueous solution of the aggregating agent is preferably not less than 2% by mass, more preferably not less than 4% by mass, and still more preferably not less than 6% by mass, and is also preferably not more than 40% by mass, more preferably not more than 30% by mass, still more preferably not more than 20% by mass, and even still more preferably not more than 10% by mass, from the viewpoint of well controlling the aggregation to obtain aggregated particles having a desired particle size.

The dropwise addition time of the aggregating agent is preferably not less than 1 min, and more preferably not less than 3 min, from the viewpoint of well controlling the aggregation to obtain aggregated particles having a desired particle size, and is also preferably not more than 120 min, more preferably not more than 30 min, and still more preferably not more than 10 min, from the viewpoint of enhancing a productivity of the toner.

The temperature used upon the dropwise addition of the aggregating agent is preferably not lower than 0° C., more preferably not lower than 10° C., and still more preferably not lower than 20° C., and is also preferably not higher than 45° C., more preferably not higher than 40° C., still more preferably not higher than 35° C., and even still more preferably not higher than 30° C., from the viewpoint of enhancing a productivity of the toner.

Furthermore, from the viewpoints of promoting the aggregation and obtaining aggregated particles having desired particle size and particle size distribution, the temperature of the dispersion obtained after adding the aggregating agent thereto is preferably raised. The temperature of the dispersion to be maintained is preferably not lower than 50° C. and not higher than 70° C. The volume median particle size of the aggregated particles is preferably monitored in the aforementioned temperature range to confirm proceeding of the aggregation. The lower limit of the temperature of the dispersion is preferably not lower than 52° C., more preferably not lower than 55° C., and still more preferably not lower than 58° C., from the viewpoint of satisfying both of a good low-temperature fusing property and a good heat-resistant storage stability of the resulting toner.

From the viewpoint of satisfying both of a good low-temperature fusing property and a good heat-resistant storage stability of the resulting toner, the volume median particle size ($D_{50}$) of the obtained aggregated particles (1) is preferably not less than 2 μm, more preferably not less than 3 μm, and still more preferably not less than 4 μm, and is also preferably not more than 10 μm, more preferably not more than 8 μm, and still more preferably not more than 6 μm. Meanwhile, the volume median particle size may be measured by the method described in Examples below.

The step (1) preferably further includes the following steps (1-1) to (1-3) from the viewpoint of improving a low-temperature fusing property and a heat-resistant storage stability of the resulting toner.

Step (1-1): obtaining a mixture containing the composite resin that contains the segment constituted of the polyester resin (a) obtained by polycondensing the alcohol component containing 80 mol % or more of the propyleneoxide adduct of bisphenol A and the polycarboxylic acid component, and the vinyl-based resin segment containing a constitutional unit derived from the styrene-based compound, and the wax;

Step (1-2); adding a neutralizing agent and then the aqueous medium to the mixture containing the composite resin and the wax which is obtained in the step (1-1) to subject the mixture to phase inversion emulsification, thereby obtaining an aqueous dispersion of the resin particles (X); and In the step (1-2), adding a neutralizing agent to the mixture containing the composite resin and the wax which is obtained in the step (1-1), and then adding the aqueous medium thereto to subject the mixture to phase inversion emulsification thereby obtaining an aqueous dispersion of the resin particles (X).

Step (1-3); aggregating the resin particles (X) in the aqueous dispersion obtained in the step (1-2) to obtain the aggregated particles (1).

(Step (1-1))

In the step (1-1), there is obtained a mixture containing the composite resin that contains the segment constituted of the polyester resin (a) obtained by polycondensing the alcohol component containing 80 mol % or more of the propyleneoxide adduct of bisphenol A and the polycarboxylic acid component, and the vinyl-based resin segment containing a constitutional unit derived from the styrene-based compound, and the wax.

As the method of performing the step (1-1), there may be mentioned a method in which the composite resin, the wax and the aforementioned other optional components are dissolved in an organic solvent to obtain the aimed mixture in the form of a solution containing the composite resin and the wax, and a method in which the composite resin, the wax and the other optional components are melted and mixed to obtain the aimed mixture in the form of a resin mixture containing the composite resin and the wax.

The kind and amount of organic solvent used in the step (1-1) are the same as the kind and amount of organic solvent used in the above method (1-1), and the preferred forms thereof are also the same as those described in the method (1-1).

(Step (1-2))

In the step (1-2), a neutralizing agent is added to the mixture containing the composite resin and the wax which is obtained in the step (1-1), and then the aqueous medium is added thereto to subject the mixture to phase inversion emulsification, thereby obtaining an aqueous dispersion of the resin particles (X).

Thus, by subjecting the mixture containing the composite resin and the wax to mixing, neutralization and phase inversion emulsification upon the emulsification step, it is possible to produce the uniform resin particles (X) in which the wax is enclosed.

The reason therefor is considered to be that the vinyl-based resin segment in the composite resin contains the constituent derived from the hydrophobic styrene-based compound, the wax has a high affinity to the hydrophobic segment, and the neutralized polyester segment has a high hydrophilicity, so that the uniform resin particles (X) constituted of the composite resin in which the wax is enclosed can be stably dispersed in water.

Thus, it is considered that when introducing the uniform resin particles (X) in which the wax is enclosed into the core portion of the toner, and applying the shell-forming resin particles (Y) having a low compatibility with the core portion onto the core portion, it is possible to prevent isolation of the wax into water in the subsequent aggregating step and coalescing step as well as exposure of the wax onto a surface of the toner, and suppress occurrence of toner cloud.

The kind of neutralizing agent, the degree of neutralization of the composite resin with the neutralizing agent, the kind and amount of aqueous medium added therein, and the temperature and velocity of addition of the aqueous medium, used in the step (1-2), are the same as those described with respect to the conditions of the method (1-1), and the preferred forms thereof are also the same as those described in the method (1-1).

After completion of the phase inversion emulsification, the step of removing the organic solvent from the dispersion obtained in the phase inversion emulsification may be conducted, if required. The method of removing the organic solvent is the same as that described with respect to the conditions of the method (1-1), and the preferred forms thereof are also the same as those described in the method (1-1).

(Step (1-3))

In the step (1-3), the resin particles (X) in the aqueous dispersion obtained in the step (1-2) are aggregated to obtain the aggregated particles (1).

The method of obtaining the aggregated particles (1) is the same method as described in the above paragraph "Production of Aggregated Particles (1)", and the preferred forms thereof are also the same as those described in the above paragraph "Production of Aggregated Particles (1)".

Also, when using a hydrocarbon wax as the wax, from the viewpoint of uniformly mixing the wax in the composite resin, the step (1) preferably further includes the following steps (1-1) to (1-3').

Step (1-1°): conducting at least one of a polycondensation reaction of the alcohol component containing 80 mol % or more of the propyleneoxide adduct of bisphenol A and the polycarboxylic acid component, and an addition polymerization reaction of the vinyl monomer as the raw material from which the vinyl-based resin segment is derived, in the presence of the wax, to obtain a mixture containing the composite resin and the wax;

Step (1-2'): after adding a neutralizing agent to the mixture containing the composite resin and the wax which is obtained in the step (1-1'), adding the aqueous medium thereto to subject the mixture to phase inversion emulsification, thereby obtaining an aqueous dispersion of the resin particles (X); and Step (1-3'): aggregating the resin particles (X) in the aqueous dispersion obtained in the step (1-2') to obtain the aggregated particles (1).

(Step (1-1'))

In the step (1-1'), at least one of a polycondensation reaction of the alcohol component containing 80 mol % or more of the propyleneoxide adduct of bisphenol A and the polycarboxylic acid component, and an addition polymerization reaction of the vinyl monomer as the raw material from which the vinyl-based resin segment is derived, is conducted in the presence of the wax, to obtain a mixture containing the composite resin and the wax.

More specifically, it is more preferred that in the production method (i) of the composite resin, after conducting the step (A) of the polycondensation reaction of the alcohol component and the polycarboxylic acid component, the wax is added to the reaction system, and then the step (B) of the addition polymerization reaction of the vinyl monomer as the raw material from which the vinyl-based resin segment is derived, if required, with the bireactive monomer, is conducted.

In addition, it is still more preferred that after conducting the step (A) of the polycondensation reaction of the alcohol component and a part of the polycarboxylic acid component in the presence of the esterification catalyst and, if required, the esterification co-catalyst, the wax, the vinyl monomer as the raw material from which the vinyl-based resin segment is derived, the radical polymerization initiator and, if required, the bireactive monomer, are added to the reaction system to conduct the step (B) of the addition polymerization reaction, and then a remaining part of the polycarboxylic acid component is added thereto to further subject the reaction mixture to the polycondensation reaction.

In the case of using the composite resin that is produced in the presence of the wax, it may be difficult to measure a softening point, a glass transition temperature and an acid value of the composite resin solely, and therefore the softening point, glass transition temperature and acid value as described hereunder respectively mean values of a softening point, a glass transition temperature and an acid value of the mixture containing the composite resin and the wax as measured by the methods described in Examples below.

The softening point of the mixture containing the composite resin and the wax which is obtained in the step (1-1') is preferably not lower than 70° C., more preferably not lower than 75° C., still more preferably not lower than 80° C., and even still more preferably not lower than 90° C., and is also preferably not higher than 165° C., more preferably not higher than 140° C., still more preferably not higher than 120° C., and even still more preferably not higher than 110° C., from the viewpoint of improving a low-temperature fusing property and a heat-resistant storage stability of the resulting toner.

The glass transition temperature of the mixture containing the composite resin and the wax which is obtained in the step (1-1') is preferably not lower than 30° C., more preferably not lower than 35° C., and still more preferably not lower than 40° C., and is also preferably not higher than 60° C., more preferably not higher than 55° C., still more preferably lower than 55° C., even still more preferably not higher than 50° C., further even still more preferably not higher than 47° C., and further even still more preferably not higher than 45° C., from the viewpoint of improving a low-temperature fusing property and a heat-resistant storage stability of the resulting toner.

The acid value of the mixture containing the composite resin and the wax which is obtained in the step (1-0 is preferably not less than 5 mgKOH/g, more preferably not less than 10 mgKOH/g, and still more preferably not less than 15 mgKOH/g, and is also preferably not more than 40 mgKOH/g, more preferably not more than 35 mgKOH/g, and still more preferably not more than 30 mgKOH/g, from the viewpoints of improving a dispersion stability of the resin particles (X) containing the composite resin in the aqueous medium and improving a heat-resistant storage stability of the resulting toner.

(Step (1-2'))

In the step (1-2'), after adding a neutralizing agent to the mixture containing the composite resin and the wax which is obtained in the step (1-1'), the aqueous medium is added thereto to subject the mixture to phase inversion emulsification, thereby obtaining an aqueous dispersion of the resin particles (X).

The kind of neutralizing agent, the degree of neutralization of the composite resin with the neutralizing agent, the kind and amount of aqueous medium added therein, and the temperature and velocity of addition of the aqueous medium, used in the step (1-2'), are the same as those described with respect to the conditions of the method (1-1), and the preferred forms thereof are also the same as those described in the method (1-1).

After completion of the phase inversion emulsification, the step of removing the organic solvent from the dispersion obtained in the phase inversion emulsification may be conducted, if required. The method of removing the organic solvent is the same as that described with respect to the conditions of the method (1-1), and the preferred forms thereof are also the same as those described in the method (1-1).

(Step (1-3'))

In the step (1-3'), the resin particles (X) in the aqueous dispersion obtained in the step (1-2') are aggregated to obtain the aggregated particles (1).

The method of obtaining the aggregated particles (1) is the same method as described in the above paragraph "Production of Aggregated Particles (1)", and the preferred forms thereof are also the same as those described in the above paragraph "Production of Aggregated Particles (1)".

<Step (2)>

In the step (2), the aggregated particles (1) obtained in the step (1) are aggregated with resin particles (Y) containing a polyester resin (b) obtained by polycondensing an alcohol component containing 80 mol % or more of an ethyleneoxide adduct of bisphenol A and a polycarboxylic acid component to obtain aggregated particles (2).

Meanwhile, the step of aggregating the aggregated particles (1) obtained in the step (1) with the resin particles (Y) to obtain the aggregated particles (2) is hereinafter also referred to as an "aggregating step (2)".

(Resin Particles (Y))

The resin particles (Y) are resin particles constituting the shell portion of the toner produced by the production process of the present invention, and contain a polyester resin (b) obtained by polycondensing an alcohol component containing 80 mol % or more of an ethyleneoxide adduct of bisphenol A and a polycarboxylic acid component.

[Polyester Resin (b)]

The polyester resin (b) is obtained by polycondensing the alcohol component containing 80 mol % or more of an ethyleneoxide adduct of bisphenol A (hereinafter also referred to as an "alcohol component (b-al)") and the polycarboxylic acid component (hereinafter also referred to as a "polycarboxylic acid component (b-ac)"), from the viewpoint of satisfying both of a good low-temperature fusing property and a good heat-resistant storage stability of the resulting toner.

The content of the polyester resin (b) in the resin component constituting the resin particles (Y) is preferably not less than 80% by mass, more preferably not less than 90% by mass, still more preferably not less than 95% by mass, even still more preferably not less than 98% by mass, and further even still more preferably 100% by mass, from the viewpoint of improving a low-temperature fusing property of the resulting toner.

The polyester resin (b) preferably contains an acid group at a terminal end of a molecule thereof, from the viewpoint of improving a dispersion stability of the resin particles (Y) containing the polyester resin (b). Examples of the acid group include a carboxy group, a sulfonic group, a phosphonic group and a sulfinic group. Of these acid groups, preferred is a carboxy group from the viewpoint of improving a dispersion stability of the resin particles (Y).

<<Alcohol Component (b-al)>>

The alcohol component (b-al) contains 80 mol % or more of an ethyleneoxide adduct of bisphenol A from the viewpoint of improving a low-temperature fusing property and a heat-resistant storage stability of the resulting toner.

In the production process of the present invention, the resin component constituting the shell portion contains the polyester resin (b) containing the ethyleneoxide adduct of bisphenol A which is more hydrophilic than the resin used in the core portion as a main constitutional unit thereof. Therefore, it is considered that the dispersion stability of the particles in the step of obtaining the aggregated particles (2) and the step of coalescing the aggregated particles (2) can be improved, which leads to a good hetero-aggregation property. As a result, it is considered that the obtained toner particles have uniform composition and particle size, and the resulting toner has a good charge distribution and is excellent in developability (dot reproducibility).

The content of the ethyleneoxide adduct of bisphenol A in the alcohol component (b-al) is preferably not less than 90 mol %, more preferably not less than 95 mol %, still more preferably not less than 98 mol %, and even still more preferably 100 mol %, from the viewpoint of satisfying both of a good low-temperature fusing property and a good heat-resistant storage stability of the resulting toner.

The average molar number of addition of ethyleneoxide in the ethyleneoxide adduct of bisphenol A is preferably not less than 1, more preferably not less than 1.2, and still more preferably not less than 1.5, and is also preferably not more than 16, more preferably not more than 12, still more preferably not more than 8, and even still more preferably not more than 4, from the viewpoint of satisfying both of a good low-temperature fusing property and a good heat-resistant storage stability of the resulting toner.

The alcohol component (b-al) may also contain an alcohol other than the ethyleneoxide adduct of bisphenol A. Examples of the other alcohol which may be contained in the alcohol component (b-al) include aliphatic diols, aromatic diols, alicyclic diols, trivalent or higher-valent polyhydric alcohols, and $C_2$ to $C_4$ alkyleneoxide adducts of these alcohols (average molar number of addition of the alkyleneoxide; not less than 1 and not more than 16).

Specific examples of the other alcohol which may be contained in the alcohol component (b-al) include aliphatic diols such as ethylene glycol, 1,2-propanediol, 1,3-propanediol, 1,2-butanediol, 1,3-butanediol, 1,4-butanediol, 2,3-butanediol, neopentyl glycol, 1,4-butenediol, 1,5-pentanediol, 1,6-hexanediol, 1,8-octanediol, 1,9-nonanediol, 1,10-decanediol and 1,12-dodecanediol; aromatic diols such as bisphenol A or propyleneoxide adducts thereof (average molar number of addition of propyleneoxide: not less than 1 and not more than 16); alicyclic diols such as cyclohexanediol, cyclohexane dimethanol, hydrogenated bisphenol A or $C_2$ to $C_4$ alkyleneoxide adducts thereof (average molar number of addition of the alkyleneoxide: not less than 2 and not more than 12); and trivalent or higher-valent polyhydric alcohols such as glycerol, pentaerythritol, trimethylolpropane and sorbitol or $C_2$ to $C_4$ alkyleneoxide adducts thereof (average molar number of addition of the alkyleneoxide: not less than 1 and not more than 16).

Of these alcohols, preferred is a propyleneoxide adduct of bisphenol A.

These other alcohols which may be contained in the alcohol component (b-al) may be used alone or in combination of any two or more thereof.

<<Polycarboxylic Acid Component (b-ac)>>

Examples of the polycarboxylic acid component (b-ac) include dicarboxylic acids, trivalent or higher-valent polycarboxylic acids, and anhydrides and $C_1$ to $C_3$ alkyl esters of these acids. Of these acids, preferred are dicarboxylic acids, and more preferred is combination of a dicarboxylic acid and a trivalent or higher-valent polycarboxylic acid.

Examples of the dicarboxylic acids include aromatic dicarboxylic acids, aliphatic dicarboxylic acids, and alicyclic dicarboxylic acids. Of these dicarboxylic acids, preferred are aromatic dicarboxylic acids and aliphatic dicarboxylic acids, and more preferred are aromatic dicarboxylic acids.

The polycarboxylic acid component (b-ac) may also include, in addition to the free acids, anhydrides and $C_1$ to $C_3$ alkyl esters of the carboxylic acids capable of producing an acid by decomposition thereof during the reaction.

Examples of the aromatic dicarboxylic acids include phthalic acid, isophthalic acid and terephthalic acid. Of these aromatic dicarboxylic acids, from the viewpoint of improving a heat-resistant storage stability of the resulting toner, preferred are isophthalic acid and terephthalic acid, and more preferred is terephthalic acid.

From the viewpoint of improving a low-temperature fusing property and a heat-resistant storage stability of the resulting toner, the aliphatic dicarboxylic acids preferably have not less than 2 and not more than 30 carbon atoms, and more preferably not less than 3 and not more than 20 carbon atoms.

Examples of the aliphatic dicarboxylic acids having not less than 2 and not more than 30 carbon atoms include oxalic acid, malonic acid, maleic acid, fumaric acid, citraconic acid, itaconic acid, glutaconic acid, succinic acid, adipic acid, sebacic acid, 1,12-dodecanedioic acid, azelaic acid, and succinic acids substituted with an alkyl group having not less than 1 and not more than 20 carbon atoms or an alkenyl group having not less than 2 and not more than 20 carbon atoms. Of these aliphatic dicarboxylic acids, preferred is at least one compound selected from the group consisting of fumaric acid, succinic acid and an anhydride thereof. Specific examples of the succinic acids substituted with an alkyl group having not less than 1 and not more than 20 carbon atoms or an alkenyl group having not less than 2 and not more than 20 carbon atoms include dodecyl succinic acid, dodecenyl succinic acid and octenyl succinic acid. Of these substituted succinic acids, preferred is at least one compound selected from the group consisting of dodecenyl succinic acid and an anhydride thereof.

Of the trivalent or higher-valent polycarboxylic acids, from the viewpoint of improving a low-temperature fusing property and a heat-resistant storage stability of the resulting toner, preferred are trimellitic acid and trimellitic anhydride, and more preferred is trimellitic anhydride.

The alcohol components (b-al) and the polycarboxylic acid components (b-ac) are respectively used alone or in combination of any two or more kinds thereof.

The equivalent ratio of the polycarboxylic acid component (b-ac) to the alcohol component (b-al) (COOH group/OH group) in the polyester resin (b) is preferably not less than 0.7, and more preferably not less than 0.8, and is also preferably not more than 1.2, more preferably not more than 1.1, and still more preferably not more than 1.05, from the viewpoint of improving a low-temperature fusing property and a heat-resistant storage stability of the resulting toner.

The softening point of the polyester resin (b) is preferably not lower than 70° C., more preferably not lower than 80° C., still more preferably not lower than 90° C., and even still more preferably not lower than 100° C., and is also preferably not higher than 165° C., more preferably not higher than 140° C., and still more preferably not higher than 120° C., from the viewpoint of improving a low-temperature fusing property and a heat-resistant storage stability of the resulting toner.

The glass transition temperature of the polyester resin (b) is preferably not lower than 45° C., more preferably not lower than 50° C., and still more preferably not lower than 55° C., and is also preferably not higher than 80° C., more preferably not higher than 70° C., and still more preferably not higher than 65° C., from the same viewpoint as described above.

The acid value of the polyester resin (b) is preferably not less than 5 mgKOH/g, more preferably not less than 10 mgKOH/g, and still more preferably not less than 15 mgKOH/g, and is also preferably not more than 35 mgKOH/g, more preferably not more than 30 mgKOH/g, and still more preferably not more than 25 mgKOH/g, from the viewpoints of improving a dispersion stability of the aqueous dispersion containing the polyester resin (b), and improving a heat-resistant storage stability of the resulting toner.

The polyester resin (b) may be used alone or in combination of any two or more kinds thereof.

Meanwhile, when the polyester resin (b) is used in the form of a mixture of two or more kinds of polyester resins, the softening point, glass transition temperature and acid value of the polyester resin (b) respectively mean values of a softening point, a glass transition temperature and an acid value of the mixture as measured by the methods described in Examples below.

{Production of Polyester Resin (b)}

The polyester resin (b) may be produced, for example, by subjecting the aforementioned alcohol component (b-al) and the aforementioned polycarboxylic acid component (b-ac) to polycondensation reaction in an inert gas atmosphere, if required, in the presence of an esterification catalyst, an esterification co-catalyst, etc.

As the esterification catalyst and the esterification co-catalyst, there may be mentioned the same esterification catalyst and esterification co-catalyst as used for synthesis of the aforementioned polyester segment, and the suitable amounts of the esterification catalyst and the esterification co-catalyst used are also the same as those used for synthesis of the aforementioned polyester segment.

In addition, a polymerization inhibitor may also be used in the above reaction, if required. Examples of the polymerization inhibitor include tert-butyl catechol, etc.

The amount of the polymerization inhibitor used is preferably not less than 0.001 part by mass, more preferably not less than 0.01 part by mass, and still more preferably not less than 0.03 part by mass, and is also preferably not more than 0.5 part by mass, more preferably not more than 0.3 part by mass, and still more preferably not more than 0.1 part by mass, on the basis of 100 parts by mass of a total amount of the polycarboxylic acid component (b-ac) and the alcohol component (b-al).

The temperature used in the polycondensation reaction is preferably not lower than 120° C., more preferably not lower than 160° C., and still more preferably not lower than 180° C., and is also preferably not higher than 250° C., and more preferably not higher than 240° C.

Furthermore, the reaction system is preferably held under reduced pressure in a later stage of the polymerization to accelerate the reaction.

[Production of Resin Particles (Y)]

The resin particles (Y) are preferably produced by the method of dispersing the resin component containing the polyester resin (b), if required, together with optional components such as a surfactant, in an aqueous medium to obtain an aqueous dispersion of the resin particles (Y).

As the method of obtaining the aqueous dispersion of the resin particles (Y), similarly to the method of obtaining the aqueous dispersion of the resin particles (X), there may be used a method of adding the resin and the like to the aqueous medium and subjecting the resulting mixture to dispersing treatment using a disperser, etc., a method of gradually adding the aqueous medium to the resin and the like to subject the resulting mixture to phase inversion emulsification, etc. Among these methods, from the viewpoint of improving a low-temperature fusing property of the resulting toner, the method using phase inversion emulsification is preferred.

As the method of performing the phase inversion emulsification, similarly to the method used upon obtaining the aqueous dispersion of the resin particles (X), there is preferably used a method of adding the aqueous medium to a solution prepared by dissolving the resin and the optional components such as a surfactant in an organic solvent to subject the solution to phase inversion emulsification. The preferred forms of the aqueous medium and organic solvent used above are respectively the same aqueous medium and organic solvent as used for production of the aforementioned resin particles (X).

The mass ratio of the organic solvent to the constituents of the resin particles (Y) including the resin component containing the polyester resin (b) (organic solvent/constituents of the resin particles (Y)) is preferably not less than 0.1, more preferably not less than 0.2, and still more preferably not less than 0.25, and is also preferably not more than 4, more preferably not more than 3, still more preferably not more than 1, and even still more preferably not more than 0.5, from the viewpoint of facilitating dissolution of the resin and phase inversion thereof into the aqueous medium and improving a dispersion stability of the resin particles (Y).

In the method for production of the resin particles (Y), it is also preferable to add a neutralizing agent to the solution. The preferred forms of the neutralizing agent are the same as those of the neutralizing agent used for production of the resin particles (X).

The degree (mol %) of neutralization of the resin with the neutralizing agent is preferably not less than 10 mol %, and more preferably not less than 30 mol %, and is also preferably not more than 150 mol %, more preferably not more than 120 mol %, and still more preferably not more than 100 mol %.

Meanwhile, the degree (mol %) of neutralization of the resin may be determined according to the following formula.

$$\text{Degree of Neutralization}=\{[\text{Mass (g) of Neutralizing Agent Added/Equivalent of Neutralizing Agent}]/[\text{Acid Value of Resin (mgKOH/g)}\times\text{Mass (g) of Resin}]/(56\times1000)]\}\times100.$$

The amount of the aqueous medium added is preferably not less than 100 parts by mass, more preferably not less than 150 parts by mass, and still more preferably not less than 200 parts by mass, and is also preferably not more than 900 parts by mass, more preferably not more than 600 parts by mass, and still more preferably not more than 400 parts by mass, on the basis of 100 parts by mass of the resin component containing the polyester resin (b), from the viewpoint of improving a dispersion stability of the resin particles (Y).

In addition, from the viewpoint of improving a dispersion stability of the resin particles (Y), the mass ratio of the aqueous medium to the organic solvent (aqueous medium/organic solvent) is preferably not less than 20/80, more preferably not less than 33/67, still more preferably not less than 50/50, even still more preferably not less than 67/33, and further even still more preferably not less than 80/20, and is also preferably not more than 99/1, more preferably not more than 95/5, still more preferably not more than 93/7, and even still more preferably not more than 92/8.

The temperature used upon adding the aqueous medium is preferably not lower than a glass transition temperature of the resin, from the viewpoint of improving a dispersion stability of the resin particles (Y). More specifically, the temperature used upon adding the aqueous medium is preferably not lower than 60° C., and more preferably not lower than 65° C., and is also preferably not higher than 85° C., more preferably not higher than 80° C., and still more preferably not higher than 75° C., from the viewpoint of improving a dispersion stability of the resin particles (Y).

From the viewpoint of obtaining the resin particles (Y) having a small particle size, the velocity of addition of the aqueous medium until terminating the phase inversion is preferably not less than 0.1 part by mass/min, more preferably not less than 0.5 part by mass/min, still more preferably not less than 1 part by mass/min, and even still more preferably not less than 3 parts by mass/min, and is also preferably not more than 50 parts by mass/min, more preferably not more than 30 parts by mass/min, still more preferably not more than 20 parts by mass/min, and even still more preferably not more than 10 parts by mass/min, on the basis of 100 parts by mass of the resin component containing the polyester resin (b). The velocity of addition of the aqueous medium after terminating the phase inversion is not particularly limited.

After completion of the phase inversion emulsification, the step of removing the organic solvent from the dispersion obtained in the phase inversion emulsification may be conducted, if required.

The method of removing the organic solvent is not particularly limited, and an optional method may be used to remove the organic solvent from the dispersion.

Since the organic solvent is dissolved in water, the dispersion is preferably subjected to distillation to remove the organic solvent therefrom. In addition, it is not necessarily required to completely remove the organic solvent from the aqueous dispersion, and a small amount of the organic solvent may remain in the aqueous dispersion. In this case, the amount of the organic solvent remaining in the aqueous dispersion is preferably not more than 1% by mass, more preferably not more than 0.5% by mass, and still more preferably substantially 0%.

When removing the organic solvent by distillation, the dispersion is preferably heated to a temperature not lower than a boiling point of the organic solvent used while stirring to thereby distil off the organic solvent therefrom. In addition, from the viewpoint of maintaining a good dispersion stability of the resin particles (Y), the dispersion is more preferably heated under reduced pressure to a temperature not lower than a boiling point of the organic solvent used under the reduced pressure to distil off the organic solvent therefrom. Meanwhile, the dispersion may be heated after reducing the pressure, or may be held under reduced pressure after heating. From the viewpoint of maintaining a good dispersion stability of the resin particles (Y), the organic solvent is preferably distilled off from the dispersion under constant temperature and constant pressure conditions.

The solid content of the resulting aqueous dispersion of the resin particles (Y) is preferably not less than 7% by mass, more preferably not less than 10% by mass, and still more preferably not less than 20% by mass, and is also preferably not more than 50% by mass, more preferably not more than 40% by mass, and still more preferably not more than 30% by mass, from the viewpoints of enhancing a productivity of the toner and improving a dispersion stability of the resin particles (Y). Meanwhile, the solid content means a total content of non-volatile components including resins, surfactants and the like.

The volume median particle size (D50) of the resin particles (Y) in the aqueous dispersion is preferably not less than 0.05 μm, more preferably not less than 0.08 μm, and still more preferably not less than 0.10 μm, and is also preferably not more than 0.50 μm, more preferably not more than 0.40 μm, and still more preferably not more than 0.30 μm, from the viewpoint of obtaining a toner capable of forming a high quality image.

The coefficient of variation of particle size distribution (CV: %) of the resin particles (Y) is preferably not less than 5%, more preferably not less than 10%, and still more preferably not less than 15%, from the viewpoint of enhancing a productivity of the aqueous dispersion of the resin particles (Y), and is also preferably not more than 50%, more preferably not more than 40%, and still more preferably not more than 30%, from the viewpoint of obtaining a toner capable of forming a high quality image.

(Production of Aggregated Particles (2))

In the step (2), it is preferred that the aqueous dispersion of the resin particles (Y) is added to the dispersion of the aforementioned aggregated particles (1) to allow the resin particles (Y) to further adhere onto the aggregated particles (1), thereby obtaining aggregated particles (2).

Before adding the aqueous dispersion of the resin particles (Y) to the dispersion of the aggregated particles (1), the dispersion of the aggregated particles (1) may be diluted by adding an aqueous medium thereto. When the aqueous dispersion of the resin particles (Y) is added to the dispersion of the aggregated particles (1), the above aggregating agent may also be used in the step (2) in order to allow the resin particles (Y) to efficiently adhere onto the aggregated particles (1).

As the preferred method of adding the aqueous dispersion of the resin particles (Y) to the dispersion of the aggregated particles (1), there may be mentioned a method in which the aggregating agent and the aqueous dispersion of the resin particles (Y) are added simultaneously to the dispersion of the aggregated particles (1), a method in which the aggregating agent and the aqueous dispersion of the resin particles (Y) are added alternately to the dispersion of the aggregated particles (1), a method in which the aqueous dispersion of the resin particles (Y) is added to the dispersion of the aggregated particles (1) while gradually raising a temperature of the dispersion of the aggregated particles (1), etc. By using these methods, it is possible to prevent deterioration in aggregating property of the aggregated particles (1) and the resin particles (Y) owing to decrease in concentration of the aggregating agent therein. From the viewpoints of improving productivity of the toner and simplifying production thereof, among these methods, there is preferably used the method in which the aqueous dispersion of the resin particles (Y) is added to the dispersion of the aggregated particles (1) while gradually raising a temperature of the dispersion of the aggregated particles (1).

The temperature upon adding the aqueous dispersion of the resin particles (Y) is preferably not lower than 40° C., more preferably not lower than 45° C., and still more preferably not lower than 50° C., and is also preferably not higher than 80° C., more preferably not higher than 70° C., and still more preferably not higher than 65° C., from the viewpoint of satisfying both of a good low-temperature fusing property and a good heat-resistant storage stability of the resulting toner.

The aqueous dispersion of the resin particles (Y) may be added continuously over a predetermined period of time, or may be added at one time or split-added plural times. The aqueous dispersion of the resin particles (Y) is preferably added continuously over a predetermined period of time or split-added plural times. By adding the aqueous dispersion of the resin particles (Y) in the aforementioned manner, the resin particles (Y) are likely to selectively adhere onto the aggregated particles (1). Among these addition methods, from the viewpoints of promoting selective adhesion of the resin particles (Y) onto the aggregated particles (1) and enhancing a productivity of the toner, the aqueous dispersion of the resin particles (Y) is more preferably added continuously over a predetermined period of time. The time period of continuously adding the aqueous dispersion of the resin particles (Y) to the dispersion of the aggregated particles (1) is preferably not less than 1 h, and more preferably not less than 2 h, and is also preferably not more than 10 h, and more preferably not more than 7 h, from the viewpoints of obtaining the uniform aggregated particles (2) and enhancing a productivity of the toner.

The velocity of continuous addition of the aqueous dispersion of the resin particles (Y) to the dispersion of the aggregated particles (1) is preferably not less than 0.1 mL/min, more preferably not less than 0.3 mL/min, and still more preferably not less than 0.5 mL/min, and is also preferably not more than 2.0 mL/min, more preferably not more than 1.5 mL/min, and still more preferably not more than 1.0 mL/min, on the basis of 100 parts by mass of the aggregated particles (1), from the viewpoints of obtaining the uniform aggregated particles (2) and enhancing a productivity of the toner.

From the viewpoint of satisfying both of a good low-temperature fusing property and a good heat-resistant storage stability of the resulting toner, the amount of the resin particles (Y) added is controlled such that the mass ratio of the resin particles (Y) to the resin particles (X) (resin particles (Y)/resin particles (X)) is preferably not less than 0.1, more preferably not less than 0.15, still more preferably not less than 0.2, and even still more preferably not less than 0.25, and is also preferably not more than 0.9, more preferably not more than 0.6, and still more preferably not more than 0.4.

The volume median particle size ($D_{50}$) of the resulting aggregated particles (2) is preferably not less than 2 μm, more preferably not less than 3 ∞m, and still more preferably not less than 4 μm, and is also preferably not more than 10 μm, more preferably not more than 8 μm, and still more preferably not more than 6 μm, from the viewpoints of obtaining a toner capable of forming a high quality image and satisfying both of a good low-temperature fusing property and a good heat-resistant storage stability of the resulting toner.

At the time at which a whole amount of the resin particles (Y) are added and growth of a toner having an appropriate particle size is achieved, the aggregating step may be stopped.

As the method of stopping the aggregating step, there may be used a method of cooling the dispersion, a method of adding an aggregation stopping agent, a method of diluting the dispersion, etc. Of these methods, from the viewpoint of surely preventing occurrence of unnecessary aggregation, preferred is the method of stopping the aggregating step by adding an aggregation stopping agent.

[Aggregation Stopping Agent]

As the aggregation stopping agent, a surfactant is preferably used. The aggregation stopping agent is more preferably an anionic surfactant. Examples of the anionic surfactants include alkylbenzenesulfonic acid salts, alkylsulfuric acid salts, alkylethersulfuric acid salts, and polyoxyalkylene alkylethersulfuric acid salts. Of these anionic surfactants, preferred are polyoxyalkylene alkylethersulfuric acid salts, more preferred are polyoxyethylene laurylethersulfuric acid salts, and still more preferred is sodium polyoxyethylene laurylethersulfate.

These aggregation stopping agents may be used alone or in combination of any two or more thereof.

The amount of the aggregation stopping agent added is preferably not less than 0.1 part by mass, more preferably not less than 1 part by mass, and still more preferably not less than 2 parts by mass, on the basis of 100 parts by mass of a total amount of the resin particles (X) and the resin particles (Y), from the viewpoint of surely preventing occurrence of unnecessary aggregation, and is also preferably not more than 15 parts by mass, more preferably not more than 10 parts by mass, and still more preferably not more than 7 parts by mass, on the basis of 100 parts by mass of a total amount of the resin particles (X) and the resin particles (Y), from the viewpoint of reducing an amount of the aggregation stopping agent remaining in the toner. The aggregation stopping agent is preferably added in the form of an aqueous solution thereof, from the viewpoint of enhancing a productivity of the toner.

The temperature used upon adding the aggregation stopping agent is preferably the same as the temperature at which the dispersion of the aggregated particles (2) is to be maintained. More specifically, the temperature used upon adding the aggregation stopping agent is preferably not lower than 50° C., and more preferably not lower than 60° C., and is also preferably not higher than 75° C., and more preferably not higher than 70° C.

<Step (3)>

In the step (3), the aggregated particles (1) and the resin particles (Y) contained in the aggregated particles (2) obtained in the step (2) are coalesced to obtain core-shell particles.

The respective particles contained in the aggregated particles which are adhered to each other mainly only by a physical force are integrally coalesced together in this step to thereby form toner particles having a core-shell structure.

In the step (3), from the viewpoints of improving a coalescence property of the aggregated particles and satisfying both of a good low-temperature fusing property and a good heat-resistant storage stability of the resulting toner, the reaction system is maintained at a temperature not lower than a glass transition temperature of the polyester resin (b).

From the viewpoints of improving a coalescence property of the aggregated particles and enhancing a productivity of the toner, the temperature to be maintained in the coalescing step is preferably not lower than a temperature higher by 2° C. than the glass transition temperature of the polyester resin (b), more preferably not lower than a temperature higher by 3° C. than the glass transition temperature, and still more preferably not lower than a temperature higher by 5° C. than the glass transition temperature, and is also preferably not higher than a temperature higher by 30° C. than the glass transition temperature of the polyester resin (b), more preferably not higher than a temperature higher by 20° C. than the glass transition temperature, and still more preferably not higher than a temperature higher by 10° C. than the glass transition temperature.

The time period to be maintained at a temperature not lower than the glass transition temperature of the polyester resin (b) is preferably not less than 1 min, more preferably not less than 10 min, and still more preferably not less than 30 min, and is also preferably not more than 240 min, more preferably not more than 180 min, still more preferably not more than 120 min, and even still more preferably not more than 90 min, from the viewpoint of satisfying both of a good low-temperature fusing property and a good heat-resistant storage stability of the resulting toner.

From the viewpoint of satisfying both of a good low-temperature fusing property and a good heat-resistant storage stability of the resulting toner, the volume median particle size ($D_{50}$) of the core-shell particles obtained in the step (3) is preferably not less than 2 μm, more preferably not less than 3 μm, and still more preferably not less than 4 μm, and is also preferably not more than 10 μm, more preferably not more than 8 μm, and still more preferably not more than 6 μm.

Meanwhile, the volume median particle size of the core-shell particles obtained in the step (3) is preferably not more than the volume median particle size of the aggregated particles (2). That is, in the step (3), the aggregated particles are preferably free from further aggregation and coalescing therebetween.

In addition, the mass ratio of the resin component of the core portion to the resin component of the shell portion thereof (core-shell ratio) of the respective core-shell particles obtained in the step (3) is preferably not less than 1.5, more preferably not less than 2.0, and still more preferably not less than 2.5, and is also preferably not more than 9.0, more preferably not more than 7.0, still more preferably not more than 5.0, and even still more preferably not more than 4.0.

<Additional Treatment Step>

In the present invention, subsequent to completion of the step (3), the obtained dispersion may be subjected to an additional treatment step. In the additional treatment step, the core-shell particles are preferably isolated from the dispersion to obtain toner particles.

The core-shell particles obtained in the step (3) are present in the aqueous medium. Therefore, the dispersion is preferably first subjected to solid-liquid separation. The solid-liquid separation procedure is preferably conducted by a suction filtration method, etc.

The particles obtained by the solid-liquid separation are preferably then washed. In this case, the surfactant added is also preferably removed by washing. Therefore, the resulting particles are preferably washed with an aqueous medium at a temperature not higher than a cloud point of the surfactant. The washing treatment is preferably carried out plural times.

Next, the obtained core-shell particles are preferably dried. The temperature upon drying the particles is preferably controlled such that the temperature of the core-shell particles themselves is preferably lower than a glass transition temperature of the composite resin, and more preferably lower by 10° C. or more than the glass transition temperature. As the drying method, there are preferably used a low-temperature vacuum drying method, a vibration-type fluidization drying method, a spray-drying method, a freeze-drying method and a flash jet method, etc. The content of water in the particles obtained after drying is preferably adjusted to not more than 1.5% by mass, and more preferably not more than 1.0% by mass, from the viewpoint of improving a charging property of the resulting toner.

(Toner Particles)

The toner particles obtained by the drying, etc., may be directly used as a toner for development of electrostatic images. It is preferred that the toner particles are subjected to the below-mentioned surface treatment, and the thus surface-treated toner particles are used as the toner for development of electrostatic images.

The volume median particle size ($D_{50}$) of the toner particles is preferably not less than 2 μm, more preferably not less than 3 μm, and still more preferably not less than 4 μm, and is also preferably not more than 10 μm, more preferably not more than 8 μm, and still more preferably not more than 6 μm, from the viewpoints of enhancing a productivity of the toner and satisfying both of a good low-temperature fusing property and a good heat-resistant storage stability of the resulting toner.

The CV of the toner particles is preferably not less than 12%, more preferably not less than 14%, and still more preferably not less than 16%, from the viewpoint of enhancing a productivity of the toner, and is also preferably not more than 30%, more preferably not more than 26%, and still more preferably not more than 23%, from the viewpoint of obtaining a toner capable of forming a high quality image.

The circularity of the toner particles is preferably not less than 0.955, more preferably not less than 0.960, and still more preferably not less than 0.965, and is also preferably not more than 0.990, more preferably not more than 0.985, and still more preferably not more than 0.980, from the viewpoint of satisfying both of a good low-temperature fusing property and a good heat-resistant storage stability of the resulting toner.

(External Additives)

The thus obtained toner particles may be directly used as a toner.

The toner particles are preferably subjected to surface treatment in which an external additive such as a fluidizing agent is applied onto a surface of the respective toner particles, and the resulting surface-treated toner particles may be used as the toner.

Examples of the external additive include inorganic fine particles such as hydrophobic silica, titanium oxide fine particles, alumina fine particles, cerium oxide fine particles and carbon blacks; and polymer fine particles such as fine particles of polycarbonates, polymethyl methacrylate, silicone resins, etc. Among these fine particles, preferred are hydrophobic silica.

When subjecting the toner particles to surface treatment with the external additive, the amount of the external additive added to the toner particles is preferably not less than 1 part by mass, more preferably not less than 2 parts by mass, and still more preferably not less than 3 parts by mass, and is also preferably not more than 5 parts by mass, more preferably not more than 4.5 parts by mass, and still more preferably not more than 4.0 parts by mass, on the basis of 100 parts by mass of the toner particles.

[Toner for Development of Electrostatic Images]

The toner for development of electrostatic images according to the present invention which has a core-shell structure includes a core portion containing the composite resin that contains the segment constituted of the polyester resin (a) obtained by polycondensing the alcohol component containing 80 mol % or more of the propyleneoxide adduct of bisphenol A and the polycarboxylic acid component, and the vinyl-based resin segment containing a constitutional unit derived from the styrene-based compound; and a shell portion containing the polyester resin (b) obtained by polycondensing the alcohol component containing 80 mol % or more of the ethyleneoxide adduct of bisphenol A and the polycarboxylic acid component.

The toner according to the present invention is preferably produced by the process for producing a toner according to the present invention.

More specifically, the properties and composition of the toner according to the present invention are the same as those of the toner obtained by the production process of the present invention, and the preferred forms thereof are also the same as those of the toner obtained by the production process of the present invention.

In addition, the kinds, properties, contents and preparation methods of the composite resin, polyester resin (b), optional components such as a wax, etc., which are constituents of the toner according to the present invention, are the same as those used in the process for producing a toner according to the present invention, and the preferred forms thereof are also the same as those used in the process for producing a toner according to the present invention.

The toner for development of electrostatic images which is obtained according to the present invention can be used as one-component system developer, or can be mixed with a carrier to form a two-component system developer.

With respect to the aforementioned embodiments of the present invention, there are further disclosed the following aspects concerning the process for producing a toner for development of electrostatic images, and the toner for development of electrostatic images.

<1> A process for producing a toner for development of electrostatic images, including the following steps (1) to (3):

Step (1): aggregating resin particles (X) containing a composite resin that contains a segment constituted of a polyester resin (a) obtained by polycondensing an alcohol component (a-al) containing 80 mol % or more of a propyleneoxide adduct of bisphenol A and a polycarboxylic acid component (a-ac), and a vinyl-based resin segment containing a constitutional unit derived from a styrene-based compound, in an aqueous medium, to obtain aggregated particles (1);

Step (2): aggregating the aggregated particles (1) obtained in the step (1) with resin particles (Y) containing a polyester resin (b) obtained by polycondensing an alcohol component (b-al) containing 80 mol % or more of an ethyleneoxide adduct of bisphenol A and a polycarboxylic acid component (b-ac) to obtain aggregated particles (2); and Step (3): coalescing the aggregated particles (2) obtained in the step (2).

<2> The process for producing a toner for development of electrostatic images according to the above aspect <1>, wherein the resin particles (X) contain the composite resin and a wax.

<3> The process for producing a toner for development of electrostatic images according to the above aspect <2>, wherein the wax is preferably a hydrocarbon wax, and more preferably a paraffin wax.

<4> The process for producing a toner for development of electrostatic images according to the above aspect <2> or <3>, wherein a melting point of the wax is preferably not lower than 60° C., more preferably not lower than 65° C., and still more preferably not lower than 70° C., and is also preferably not higher than 100° C., more preferably not higher than 90° C., and still more preferably not higher than 85° C.

<5> The process for producing a toner for development of electrostatic images according to any one of the above aspects <2> to <4>, wherein a content of the wax is preferably not less than 2 parts by mass, more preferably not less than 5 parts by mass, and still more preferably not less than 8 parts by mass, and is also preferably not more than 30 parts by mass, more preferably not more than 20 parts by mass, and still more preferably not more than 15 parts by mass, on the basis of 100 parts by mass of the composite resin.

<6> The process for producing a toner for development of electrostatic images according to any one of the above aspects <2> to <5>, wherein the step (1) further includes the following steps (1-1) to (1-3):

Step (1-1): obtaining a mixture containing the composite resin that contains the segment constituted of the polyester resin (a) obtained by polycondensing the alcohol component (a-al) containing 80 mol % or more of the propyleneoxide adduct of bisphenol A and the polycarboxylic acid component (a-ac), and the vinyl-based resin segment containing a constitutional unit derived from the styrene-based compound, and the wax;

Step (1-2): adding a neutralizing agent to the mixture containing the composite resin and the wax which is obtained in the step (1-1), and then adding the aqueous medium thereto to subject the mixture to phase inversion emulsification, thereby obtaining an aqueous dispersion of the resin particles (X); and Step (1-3): aggregating the resin particles (X) in the aqueous dispersion obtained in the step (1-2) to obtain the aggregated particles (1).

<7> The process for producing a toner for development of electrostatic images according to any one of the above aspects <2> to <5>, wherein the step (1) further includes the following steps (1-1') to (1-3'):

Step (1-1'): conducting at least one of a polycondensation reaction of the alcohol component (a-al) containing 80 mol % or more of the propyleneoxide adduct of bisphenol A and the polycarboxylic acid component (a-ac), and an addition polymerization reaction of the vinyl monomer as the raw material from which the vinyl-based resin segment is derived, in the presence of the wax, to obtain a mixture containing the composite resin and the wax;

Step (1-2'): after adding a neutralizing agent to the mixture containing the composite resin and the wax which is obtained in the step (1-1'), adding the aqueous medium thereto to subject the mixture to phase inversion emulsification, thereby obtaining an aqueous dispersion of the resin particles (X); and Step (1-3'): aggregating the resin particles (X) in the aqueous dispersion obtained in the step (1-2') to obtain the aggregated particles (1).

<8> The process for producing a toner for development of electrostatic images according to the above aspect <7>, wherein a softening point of the mixture containing the composite resin and the wax which is obtained in the step (1-1) is preferably not lower than 70° C., more preferably not lower than 75° C., still more preferably not lower than 80° C., and even still more preferably not lower than 90° C., and is also preferably not higher than 165° C., more preferably not higher than 140° C., still more preferably not higher than 120° C., and even still more preferably not higher than 110° C.

<9> The process for producing a toner for development of electrostatic images according to the above aspect <7> or <8>, wherein a glass transition temperature of the mixture containing the composite resin and the wax which is obtained in the step (1-1') is preferably not lower than 30° C., more preferably not lower than 35° C., and still more preferably not lower than 40° C., and is also preferably not higher than 60° C., more preferably not higher than 55° C., still more preferably lower than 55° C., even still more preferably not higher than 50° C., further even still more preferably not higher than 47° C., and further even still more preferably not higher than 45° C.

<10> The process for producing a toner for development of electrostatic images according to any one of the above aspects <7> to <9>, wherein an acid value of the mixture containing the composite resin and the wax which is obtained in the step (1-1') is preferably not less than 5 mgKOH/g, more preferably not less than 10 mgKOH/g, an still more preferably not less than 15 mgKOH/g, and is also preferably not more than 40 mgKOH/g, more preferably not more than 35 mgKOH/g, and still more preferably not more than 30 mgKOH/g.

<11> The process for producing a toner for development of electrostatic images according to any one of the above aspects <1> to <10>, wherein a content of the propyleneoxide adduct of bisphenol A in the alcohol component (a-al) is preferably not less than 90 mol %, more preferably not less than 95 mol %, still more preferably not less than 98 mol %, and even still more preferably 100 mol %.

<12> The process for producing a toner for development of electrostatic images according to any one of the above aspects <1> to <11>, wherein an average molar number of addition of propyleneoxide in the propyleneoxide adduct of bisphenol A is preferably not less than 1, more preferably not less than 1.2, and still more preferably not less than 1.5, and is also preferably not more than 16, more preferably not more than 12, still more preferably not more than 8, and even still more preferably not more than 4.

<13> The process for producing a toner for development of electrostatic images according to any one of the above aspects <1> to <12>, wherein an equivalent ratio of the polycarboxylic acid component (a-ac) to the alcohol component (a-al) (COOH group/OH group) in the segment constituted of the polyester resin (a) is preferably not less than 0.7, more preferably not less than 0.8, and still more preferably not less than 0.9, and is also preferably not more than 1.3, more preferably not more than 1.2, and still more preferably not more than 1.1.

<14> The process for producing a toner for development of electrostatic images according to any one of the above aspects <1> to <13>, wherein a content of the segment constituted of the polyester resin (a) in the composite resin is preferably not less than 40% by mass, more preferably not less than 45% by mass, and still more preferably not less than 55% by mass, and is also preferably not more than 90% by mass, more preferably not more than 85% by mass, and still more preferably not more than 75% by mass.

<15> The process for producing a toner for development of electrostatic images according to any one of the above aspects <1> to <14>, wherein the styrene-based compound is preferably at least one compound selected from the group consisting of styrene, methyl styrene, α-methyl styrene, β-methyl styrene, t-butyl styrene, chlorostyrene, chloromethyl styrene, methoxystyrene, styrenesulfonic acid or a salt thereof, and more preferably styrene.

<16> The process for producing a toner for development of electrostatic images according to any one of the above aspects <1> to <15>, wherein a content of the styrene-based compound in the vinyl monomer as the raw material from which the vinyl-based resin segment is derived is preferably not less than 50% by mass, more preferably not less than 60% by mass, and still more preferably not less than 70% by mass, and is also preferably not more than 95% by mass, more preferably not more than 90% by mass, and still more preferably not more than 85% by mass.

<17> The process for producing a toner for development of electrostatic images according to any one of the above aspects <1> to <16>, wherein a content of the vinyl monomer component containing an alkyl group having not less than 10 and not more than 20 carbon atoms in the vinyl monomer as the raw material from which the vinyl-based resin segment is derived is preferably not less than 5% by mass, more preferably not less than 10% by mass, and still more preferably not less than 15% by mass, and is also preferably not more than 50% by mass, more preferably not more than 40% by mass, and still more preferably not more than 30% by mass.

<18> The process for producing a toner for development of electrostatic images according to the above aspect <17>, wherein the vinyl monomer component containing an alkyl group having not less than 10 and not more than 20 carbon atoms is preferably a (meth)acrylic acid ester, and more preferably an alkyl ($C_1$ to $C_{22}$) (meth)acrylate.

<19> The process for producing a toner for development of electrostatic images according to the above aspect <18>, wherein a number of carbon atoms of an alkyl group in the alkyl ($C_1$ to $C_{22}$) (meth)acrylate is preferably not less than 1, more preferably not less than 6, and still more preferably not less than 10, and is also preferably not more than 24, more preferably not more than 22, and still more preferably not more than 20.

<20> The process for producing a toner for development of electrostatic images according to any one of the above aspects <1> to <19>, wherein a content of the vinyl-based resin segment in the composite resin is preferably not less than 10% by mass, more preferably not less than 15% by mass, and still more preferably not less than 25% by mass, and is also preferably not more than 60% by mass, more preferably not more than 55% by mass, and still more preferably not more than 45% by mass.

<21> The process for producing a toner for development of electrostatic images according to any one of the above aspects <1> to <20>, wherein the vinyl-based resin segment contains a constitutional unit derived from a bireactive monomer.

<22> The process for producing a toner for development of electrostatic images according to the above aspect <21>, wherein the bireactive monomer is preferably at least one compound selected from the group consisting of acrylic acid and methacrylic acid, and more preferably acrylic acid.

<23> The process for producing a toner for development of electrostatic images according to the above aspect <21> or <22>, wherein the bireactive monomer is preferably used in an amount of not less than 1 mole part, more preferably not less than 5 mole parts, still more preferably not less than 10 mole parts, and even still more preferably not less than 13 mole parts, and also preferably not more than 30 mole parts, more preferably not more than 25 mole parts, and still more preferably not more than 20 mole parts, on the basis of 100 mole parts of a total amount of the alcohol component (a-al) as the raw material of the segment constituted of the polyester resin (a).

<24> The process for producing a toner for development of electrostatic images according to any one of the above aspects <1> to <23>, wherein a softening point of the composite resin is preferably not lower than 70° C., more preferably not lower than 75° C., still more preferably not lower than 80° C., and even still more preferably not lower than 85° C., and is also preferably not higher than 165° C., more preferably not higher than 140° C., still more preferably not higher than 120° C., and even still more preferably not higher than 110° C.

<25> The process for producing a toner for development of electrostatic images according to any one of the above aspects <1> to <24>, wherein a glass transition temperature of the composite resin is preferably not lower than 30° C., more preferably not lower than 35° C., and still more preferably not lower than 40° C., and is also preferably not higher than 60° C., more preferably not higher than 55° C., still more preferably lower than 55° C., even still more preferably not higher than 50° C., further even still more preferably not higher than 47° C., and further even still more preferably not higher than 45° C.

<26> The process for producing a toner for development of electrostatic images according to any one of the above aspects <1> to <25>, wherein an acid value of the composite resin is preferably not less than 5 mgKOH/g, more preferably not less than 10 mgKOH/g, and still more preferably not less than 15 mgKOH/g, and is also preferably not more than 40 mgKOH/g, more preferably not more than 35 mgKOH/g, and still more preferably not more than 30 mgKOH/g.

<27> The process for producing a toner for development of electrostatic images according to any one of the above aspects <1> to <26>, wherein a volume median particle size ($D_{50}$) of the resin particles (X) in the aqueous dispersion is preferably not less than 0.10 μm, more preferably not less than 0.15 μm, still more preferably not less than 0.20 μm, and even still more preferably not less than 0.35 μm, and is also preferably not more than 0.80 μm, more preferably not more than 0.70 μm, and still more preferably not more than 0.60 μm.

<28> The process for producing a toner for development of electrostatic images according to any one of the above aspects <1> to <27>, wherein a coefficient of variation of particle size distribution (CV: %) of the resin particles (X) is preferably not less than 5%, more preferably not less than 20%, and still more preferably not less than 28%, and is also preferably not more than 50%, more preferably not more than 45%, and still more preferably not more than 40%.

<29> The process for producing a toner for development of electrostatic images according to any one of the above aspects <1> to <28>, wherein a volume median particle size ($D_{50}$) of the aggregated particles (1) is preferably not less than 2 μm, more preferably not less than 3 μm, and still more preferably not less than 4 μm, and is also preferably not more than 10 μm, more preferably not more than 8 μm, and still more preferably not more than 6 μm.

<30> The process for producing a toner for development of electrostatic images according to any one of the above aspects <1> to <29>, wherein a content of the ethyleneoxide adduct of bisphenol A in the alcohol component (b-al) is preferably not less than 90 mol %, more preferably not less than 95 mol %, still more preferably not less than 98 mol %, and even still more preferably 100 mol %.

<31> The process for producing a toner for development of electrostatic images according to any one of the above aspects <1> to <30>, wherein an average molar number of addition of ethyleneoxide in the ethyleneoxide adduct of bisphenol A is preferably not less than 1, more preferably not less than 1.2, and still more preferably not less than 1.5, and is also preferably not more than 16, more preferably not more than 12, still more preferably not more than 8, and even still more preferably not more than 4.

<32> The process for producing a toner for development of electrostatic images according to any one of the above aspects <1> to <31>, wherein an equivalent ratio of the polycarboxylic acid component (b-ac) to the alcohol component (b-al) (COOH group/OH group) in the polyester resin (b) is preferably not less than 0.7, and more preferably not less than 0.8, and is also preferably not more than 1.2, more preferably not more than 1.1, and still more preferably not more than 1.05.

<33> The process for producing a toner for development of electrostatic images according to any one of the above aspects <1> to <32>, wherein a softening point of the polyester resin (b) is preferably not lower than 70° C., more preferably not lower than 80° C., still more preferably not lower than 90° C., and even still more preferably not lower than 100° C., and is also preferably not higher than 165° C., more preferably not higher than 140° C., and still more preferably not higher than 120° C.

<34> The process for producing a toner for development of electrostatic images according to any one of the above aspects <1> to <33>, wherein a glass transition temperature of the polyester resin (b) is preferably not lower than 45° C., more preferably not lower than 50° C., and still more preferably not lower than 55° C., and is also preferably not higher than 80° C., more preferably not higher than 70° C., and still more preferably not higher than 65° C.

<35> The process for producing a toner for development of electrostatic images according to any one of the above aspects <1> to <34>, wherein an acid value of the polyester resin (b) is preferably not less than 5 mgKOH/g, more preferably not less than 10 mgKOH/g, and still more preferably not less than 15 mgKOH/g, and is also preferably not more than 35 mgKOH/g, more preferably not more than 30 mgKOH/g, and still more preferably not more than 25 mgKOH/g.

<36> The process for producing a toner for development of electrostatic images according to any one of the above aspects <1> to <35>, wherein a method of producing the resin particles (Y) is preferably a method of dispersing a resin component containing the polyester resin (b) in an aqueous medium to obtain an aqueous dispersion of the resin particles (Y), and more preferably a method of adding the aqueous medium to a solution prepared by dissolving the resin component containing the polyester resin (b) in an organic solvent to subject the solution to phase inversion emulsification.

<37> The process for producing a toner for development of electrostatic images according to any one of the above aspects <1> to <36>, wherein a volume median particle size ($D_{50}$) of the resin particles (Y) is preferably not less than 0.05 μm, more preferably not less than 0.08 μm, and still more preferably not less than 0.10 μm, and is also preferably not more than 0.50 μm, more preferably not more than 0.40 μm, and still more preferably not more than 0.30 μm.

<38> The process for producing a toner for development of electrostatic images according to any one of the above aspects <1> to <37>, wherein a coefficient of variation of particle size distribution (CV: %) of the resin particles (Y) is preferably not less than 5%, more preferably not less than 10%, and still more preferably not less than 15%, and is also preferably not more than 50%, more preferably not more than 40%, and still more preferably not more than 30%.

<39> The process for producing a toner for development of electrostatic images according to any one of the above aspects <1> to <38>, wherein an amount of the resin particles (Y) added is controlled such that a mass ratio of the resin particles (Y) to the resin particles (X) (resin particles (Y)/resin particles (X)) is preferably not less than 0.1, more preferably not less than 0.15, still more preferably not less than 0.2, and even still more preferably not less than 0.25, and is also preferably not more than 0.9, more preferably not more than 0.6, and still more preferably not more than 0.4.

<40> The process for producing a toner for development of electrostatic images according to any one of the above aspects <1> to <39>, wherein a volume median particle size ($D_{50}$) of the aggregated particles (2) is preferably not less than 2 μm, more preferably not less than 3 μm, and still more preferably not less than 4 μm, and is also preferably not more than 10 μm, more preferably not more than 8 μm, and still more preferably not more than 6 μm.

<41> The process for producing a toner for development of electrostatic images according to any one of the above aspects <1> to <40>, wherein a temperature to be maintained in the coalescing step is preferably not lower than a temperature higher by 2° C. than a glass transition temperature of the polyester resin (b), more preferably not lower than a temperature higher by 3° C. than the glass transition temperature, and still more preferably not lower than a temperature higher by 5° C. than the glass transition temperature, and is also preferably not higher than a temperature higher by 30° C. than the glass transition temperature of the polyester resin (b), more preferably not higher than a temperature higher by 20° C. than the glass transition temperature, and still more preferably not higher than a temperature higher by 10° C. than the glass transition temperature.

<42> The process for producing a toner for development of electrostatic images according to any one of the above aspects <1> to <41>, wherein a time period to be maintained at a temperature not lower than the glass transition temperature of the polyester resin (b) is preferably not less than 1 min, more preferably not less than 10 min, and still more preferably not less than 30 min, and is also preferably not more than 240 min, more preferably not more than 180 min, still more preferably not more than 120 min, and even still more preferably not more than 90 min.

<43> The process for producing a toner for development of electrostatic images according to any one of the above aspects <1> to <42>, wherein a volume median particle size ($D_{50}$) of the core-shell particles obtained in the step (3) is preferably not less than 2 μm, more preferably not less than 3 μm, and still more preferably not less than 4 μm, and is also preferably not more than 10 μm, more preferably not more than 8 μm, and still more preferably not more than 6 μm.

<44> The process for producing a toner for development of electrostatic images according to any one of the above aspects <1> to <43>, wherein a mass ratio of a resin component of the core to a resin component of the shell in the core-shell particles obtained in the step (3) (core-shell ratio) is preferably not less than 1.5, more preferably not less than 2.0, and still more preferably not less than 2.5, and is also preferably not more than 9.0, more preferably not more than 7.0, still more preferably not more than 5.0, and even still more preferably not more than 4.0.

<45> The process for producing a toner for development of electrostatic images according to any one of the above aspects <1> to <44>, wherein the dispersion obtained after the step (3) is preferably subjected to an additional treatment step to isolate toner particles therefrom.

<46> The process for producing a toner for development of electrostatic images according to the above aspect <45>, wherein a volume median particle size ($D_{50}$) of the toner particles is preferably not less than 2 μm, more preferably not less than 3 μm, and still more preferably not less than 4 μm, and is also preferably not more than 10 μm, more preferably not more than 8 μm, and still more preferably not more than 6 μm.

<47> The process for producing a toner for development of electrostatic images according to the above aspect <45> or <46>, wherein CV of the toner particles is preferably not less than 12%, more preferably not less than 14%, and still more preferably not less than 16%, and is also preferably not more than 30%, more preferably not more than 26%, and still more preferably not more than 23%.

<48> The process for producing a toner for development of electrostatic images according to any one of the above aspects <45> to <47>, wherein a circularity of the toner particles is preferably not less than 0.955, more preferably not less than 0.960, and still more preferably not less than 0.965, and is also preferably not more than 0.990, more preferably not more than 0.985, and still more preferably not more than 0.980.

<49> A toner for development of electrostatic images which has a core-shell structure, including:

a core portion containing a composite resin that contains a segment constituted of a polyester resin (a) obtained by polycondensing an alcohol component containing 80 mol % or more of a propyleneoxide adduct of bisphenol A and a polycarboxylic acid component, and a vinyl-based resin segment containing a constitutional unit derived from a styrene-based compound; and a shell portion containing a polyester resin (b) obtained by polycondensing an alcohol component containing 80 mol % or more of an ethyleneoxide adduct of bisphenol A and a polycarboxylic acid component.

<50> The toner for development of electrostatic images according to the above aspect <49>, wherein a glass transition temperature of the composite resin is preferably not lower than 30° C., more preferably not lower than 35° C., and still more preferably not lower than 40° C., and is also preferably not higher than 60° C., more preferably not higher than 55° C., still more preferably lower than 55° C., even still more preferably not higher than 50° C., further even still more preferably not higher than 47° C., and further even still more preferably not higher than 45° C.

<51> The toner for development of electrostatic images according to the above aspect <49> or <50>, wherein the core portion contains a wax.

<52> The toner for development of electrostatic images according to any one of the above aspects <49> to <51>, wherein a content of the vinyl-based resin segment in the composite resin is preferably not less than 10% by mass, more preferably not less than 15% by mass, and still more preferably not less than 25% by mass, and is also preferably not more than 60% by mass, more preferably not more than 55% by mass, and still more preferably not more than 45% by mass.

EXAMPLES

Various properties of a composite resin, a polyester resin, a mixture containing the composite resin and a wax, resin particles (X) and (Y), a toner, etc., were measured and evaluated by the following methods.

[Acid Values of Composite resin, Mixture Containing Composite Resin and Wax and Polyester Resin]

Determined by the same method as prescribed in JIS K0070 except that a mixed solvent containing acetone and toluene at a volume ratio of acetone:toluene=1:1 was used as a solvent for the measurement.

[Softening Points of Composite Resin, Mixture Containing Composite Resin and Wax and Polyester Resin]

Using a flow tester "CFT-500D" available from Shimadzu Corporation, 1 g of a sample was extruded through a nozzle having a die pore diameter of 1 mm and a length of 1 mm while heating the sample at a temperature rise rate of 6° C./min and applying a load of 1.96 MPa thereto by a plunger. The softening point was determined as the temperature at which a half amount of the sample was flowed out when plotting a downward movement of the plunger of the flow tester relative to the temperature.

[Endothermic Maximum Peak Temperatures and Glass Transition Temperatures of Composite Resin and Polyester Resin]

Using a differential scanning calorimeter "Q100" available from TA Instruments Japan Inc., 0.01 to 0.02 g of a sample was weighed in an aluminum pan, and heated to 200° C. and then cooled from 200° C. to 0° C. at a temperature drop rate of 10° C./min, and thereafter heated again at a temperature rise rate of 10° C./min to measure an endotherm thereof. Among the endothermic peaks observed in the characteristic curve, the temperature of the peak having a largest peak area was defined as an endothermic maximum peak temperature (1). When any endothermic peak was observed in the characteristic curve, the temperature of the endothermic peak observed was defined as a glass transition temperature of the sample. Whereas, when a shift of the characteristic curve was observed without any peaks, the temperature at which a tangential line having a maximum inclination of the curve in the portion of the curve shift was intersected with an extension of the baseline on the high-temperature side of the curve shift was read as the glass transition temperature.

[Endothermic Maximum Peak Temperature and Glass Transition Temperature of Mixture Containing Composite Resin and Wax]

Using a differential scanning calorimeter "Q100" available from TA Instruments Japan Inc., 0.01 to 0.02 g of a sample was weighed in an aluminum pan, and heated to 200° C. and then cooled from 200° C. to 0° C. at a temperature drop rate of 10° C./min, and thereafter heated again at a temperature rise rate of 10° C./min to measure an endotherm thereof. Among the endothermic peaks observed in the characteristic curve, the temperature of the peak having a largest peak area except for the peak derived from a melting point of the wax (as measured by the below-mentioned method) was defined as an endothermic maximum peak temperature (2). When any endothermic peak was observed in the characteristic curve, the temperature of the endothermic peak observed was defined as a glass transition temperature of the sample. Whereas, when a shift of the characteristic curve was observed without any peaks, the temperature at which a tangential line having a maximum inclination of the curve in the portion of the curve shift was intersected with an extension of the baseline on the high-temperature side of the curve shift was read as the glass transition temperature.

[Melting Point of Wax]

Using a differential scanning calorimeter "Q100" available from TA Instruments Japan Inc., 0.01 to 0.02 g of a sample was weighed in an aluminum pan, and heated to 200° C. and then cooled from 200° C. to 0° C. at a temperature drop rate of 10° C./min, and thereafter heated again at a temperature rise rate of 10° C./min to measure an endotherm thereof. The endothermic maximum peak temperature observed was regarded as a melting point of the sample.

[Volume Median Particle Size ($D_{50}$) and Particle Size Distribution (CV) of Resin Particles (X), Resin Particles (Y), Colorant Particles and Wax Particles]

(1) Measuring Apparatus: Laser diffraction particle size analyzer "LA-920" commercially available from HORIBA Ltd.

(2) Measuring Conditions: Using a cell for the measurement which was filled with distilled water, a volume median particle size ($D_{50}$) and a volume-average particle size of the particles were measured at a concentration of the particles in a dispersion thereof at which an absorbance thereof fell within an adequate range. Also, the CV (particle size distribution) was calculated according to the following formula:

$$CV\ (\%) = (\text{Standard Deviation of Particle Size Distribution}/\text{Volume-Average Particle Size}) \times 100.$$

[Solid Contents of Aqueous Dispersion, Dispersion of Aggregated Particles (1), Dispersion of Aggregated Particles (2), Colorant Dispersion, and Wax Particle Dispersion]

Using an infrared moisture meter "FD-230" available from Kett Electric Laboratory, 5 g of a sample to be measured was subjected to measurement of a water content (% by mass) thereof at a drying temperature of 150° C. under a measuring mode 96 (monitoring time: 2.5 min/variation range: 0.05%). The solid content of the dispersion was calculated according to the following formula:

$$\text{Solid Content (\% by mass)} = 100 - \text{Water Content (\% by mass)}$$

[Volume Median Particle Size ($D_{50}$) of Aggregated Particles (1), Aggregated Particles (2) and Core-Shell Particles]

The volume median particle sizes ($D_{50}$) of the aggregated particles and the core-shell particles were measured as follows.

Measuring Apparatus: "Coulter Multisizer (registered tradename) III" commercially available from Beckman Coulter Inc.

Aperture Diameter: 50 μm

Analyzing Software: "Multisizer (registered tradename) III Ver. 3.51" commercially available from Beckman Coulter Inc.

Electrolyte Solution: "Isotone (registered tradename) II" commercially available from Beckman Coulter Inc.

Measuring Conditions:

The sample dispersion was added to 100 mL of the electrolyte solution, and after controlling a concentration of the resultant dispersion such that the determination for particle sizes of 30000 particles was completed within 20 s, the particle sizes of 30000 particles were measured under such a concentration condition, and a volume median particle size ($D_{50}$) thereof was determined from the particle size distribution.

[Volume Median Particle Size ($D_{50}$) and Particle Size Distribution (CV) of Toner Particles]

The volume median particle size of the toner particles was measured as follows.

The measuring apparatus, aperture diameter, analyzing software and electrolyte solution used in the measurement were the same as those used above for measuring the volume median particle sizes of the aggregated particles.

Dispersing Solution:

A polyoxyethylene lauryl ether "EMULGEN (registered tradename) 109P" (HLB: 13.6) commercially available from Kao Corporation, was dissolved in the above electrolyte solution to prepare a dispersion having a concentration of 5% by mass.

Dispersing Conditions:

Ten milligrams of the toner particles as a toner sample to be measured were added to 5 mL of the above dispersing solution, and dispersed using an ultrasonic disperser for 1 min. Thereafter, 25 mL of the electrolyte solution was added to the resulting dispersion, and the obtained mixture was further dispersed using the ultrasonic disperser for 1 min to prepare a sample dispersion.

Measuring Conditions:

The thus prepared sample dispersion was added to 100 mL of the electrolyte solution, and after controlling a concentration of the resultant dispersion such that the determination for particle sizes of 30000 particles was completed within 20 s, the particle sizes of 30000 particles were measured under such a concentration condition, and a volume median particle size ($D_{50}$) and a volume-average particle size thereof were determined from the particle size distribution.

Also, the CV was calculated according to the following formula:

CV (%)=(Standard Deviation of Particle Size Distribution/Volume-Average Particle Size)×100.

[Circularity of Toner Particles]

Using a flow-type particle image analyzer "FPIA-3000" available from Sysmex Corporation, the circularity of the toner particles was measured under the following conditions.

Preparation of Dispersion:

The dispersion to be measured was prepared by diluting the dispersion of the toner particles with deionized water such that a solid content of the resulting dispersion was from 0.001 to 0.05% by mass.

Measuring Mode: HPF Measuring Mode

[Lowest Fusing Temperature of Toner]

A solid image was outputted and printed on a wood-free paper "J Paper; A4 size" available from Fuji Xerox Co., Ltd. using a commercially available printer "Microline (registered tradename) 5400" available from Old Data Corporation. The solid image thus outputted was an unfused solid image having a length of 50 mm which was printed on a portion of the above A4 paper except for its top margin of the A4 paper extending 5 mm from a top end thereof such that an amount of the toner deposited on the paper was from 0.42 to 0.48 mg/cm$^2$.

Next, the thus obtained unfused solid image on the paper was fused by passing the paper through a fuser mounted to the same printer as used above which was however modified so as to variably control its fusing temperature. Upon fusing the image, the temperature of the fuser was adjusted to 90° C., and the fusing rate thereof was adjusted to 1.2 s per sheet in a longitudinal direction of the A4 paper, thereby obtaining a printed paper.

In addition, the same fusing procedure was conducted while increasing the fusing temperature at intervals of 5° C., thereby obtaining printed papers.

A mending tape ("Scotch (registered tradename) Mending Tape 810" available from 3M Japan Limited; width: 18 mm) was cut into a length of 50 mm and lightly attached to a portion of the respective printed papers extending from its top margin above an upper end of the solid image through the solid image-formed portion. Then, a weight of 500 g was rested on the tape and reciprocated by one stroke over the tape at a speed of 10 mm/s while press-contacting with the tape. Thereafter, the attached tape was peeled off from its lower end side at a peel angle of 180° and a peel speed of 10 mm/s, thereby obtaining the printed papers from which the tape had been peeled off. At each time before attaching the tape to the printed paper and after peeling-off the tape therefrom, the printed paper was placed on 30 sheets of a wood-free paper "EXCELLENT WHITE PAPER" (size: A4) available from Oki Data Corporation to measure a reflection image density of the fused image portion thereof using a colorimeter "SpectroEye" available from Gretag-Macbeth GmbH under the light irradiating conditions including a standard light source D50, an observation visual field of 2°, and a density standard DINNB based on an absolute white color. The fusing rate of the toner was calculated from the thus measured reflection image densities according to the following formula.

Fusing Rate (%)=(Reflection Image Density after Peeling-off Tape/Reflection Image Density before Attaching Tape)×100

The temperature at which the fusing rate first reached 90% or more was defined as a lowest fusing temperature. The lower the lowest fusing temperature, the more excellent the low-temperature fusing property of the toner becomes.

[Heat-Resistant Storage Stability of Toner]

A 100 mL-capacity wide-mouthed polymer bottle was charged with 20 g of the toner and hermetically sealed, and allowed to stand at an ambient temperature of 55° C. for 72 h. Thereafter, the sealed bottle filled with the toner was further allowed to stand at 25° C. for 6 h or longer for cooling. Next, a 250 μm-mesh sieve was fitted to a vibrating table of a "Powder Tester (registered tradename)" available from Hosokawa Micron Corporation, and 20 g of the above toner was placed on the sieve and vibrated for 30 s to measure a mass of the toner as a residue on the sieve. The smaller the mass value of the toner, the more excellent the heat-resistant storage stability of the toner becomes.

[Charge Distribution of Toner]

A 50 mL-capacity polypropylene bottle "PP Bottle Wide Mouth" available from Sanplatec Corporation, was charged with 0.6 g of a toner and 19.4 g of a ferrite carrier. The contents of the bottle were stirred using a ball mill for 20 min, and then measured for charge distribution thereof using a charge meter "q-test" available from Epping GmbH.

Measuring Conditions:

Toner Flow: 160 mL/min

Electrode Voltage: 4000 V

Deposition Time: 2 s

A graph of the charge distribution of the toner was prepared by connecting respective points of the measurement results with a line in a region where a specific charge q/d (charge/diameter) fell within the range of from −0.4 to 0.4 (fC/10 μm).

The charging property of the toner was evaluated by a half band width of a maximum peak of the charge distribution (a width of a section of the charge distribution curve formed by cutting the curve along a half value of a maximum peak height present therein). The smaller the value of the half band width, the sharper the charge distribution and the more excellent the charge stability become.

[Toner Cloud]

The following procedures all were carried out at room temperature (25° C.) and a relative humidity of 50% RH. First, 0.7 g of a toner and 9.3 g of a silicone ferrite carrier (available from Kanto Denka Kogyo Co., Ltd.; average particle size: 40 μm) were charged into a 20 mL-capacity cylindrical polypropylene bottle available from Nikko Hansen & Co., Ltd., and stirred by shaking 10 times in each of longitudinal and lateral directions. Thereafter, the resulting mixture was stirred by a ball mill for 10 min.

A developing roller (diameter: 42 mm) was dismounted from a commercially available printer "AR-505" available from Sharp Corporation and modified so as to rotate at a variable speed. The thus modified developing roller was used as an external developing roller device. The developing roller as the external developing roller device was rotated at 10 revolutions per minute, and a developer (a mixture of the toner and the silicone ferrite carrier) was allowed to adhere onto the developing roller. After allowing the developer to uniformly adhere over the developing roller, the developing roller was temporarily stopped. Then, the rotating speed of the developing roller was changed to 45 revolutions per minute to measure the number of the toner particles scattered around when rotating the developer roller at 45 revolutions per minute for 1 min using a digital dust meter "Model P-5" available from Shibata Science Technology Ltd.

The toner cloud was evaluated by the number of the toner particles scattered around. The less number of the toner particles scattered around indicates that occurrence of the toner cloud is more efficiently suppressed.

[Dot Reproducibility of Printed Images]

Using a commercially available printer "Microline (registered tradename) 5400" available from Old Data Corporation, a half tone image (2 dots, 2 space) with a resolution of 1200 dpi was printed on a wood-free paper "J Paper; A4 size" available from Fuji Xerox Co., Ltd. The thus printed image was observed by naked eyes and evaluated according to the following five ratings. As the numerical value assigned to each rating increases, the toner cloud around dots and white spots in the dots are reduced, and the dots become clearer.

5: Substantially no toner cloud around dots was recognized and the dots were very clear, and there were no white spots in the dots.

4: Although slight toner cloud around dots were recognized, the dots were still clear, and there were no white spots in dots.

3: Toner cloud around dots was recognized and the dots were slightly unclear, but there were no white spots in the dots.

2: Toner cloud around dots was recognized and the dots were slightly unclear, and there were white spots in the dots.

1: Toner cloud around dots was noticeable and the dots were unclear, and there were remarkable white spots in the dots.

[Production of Composite Resins for Core Portion]

Production Example 1

(Production of Composite Resin X1)

An inside atmosphere of a four-necked flask equipped with a nitrogen inlet tube, a dehydration tube, a stirrer and a thermocouple was replaced with nitrogen, and 3042 g of polyoxypropylene (2.2)-2,2-bis(4-hydroxyphenyl)propane, 577 g of terephthalic acid, 30 g of tin (II) di(2-ethyl hexanoate) and 3 g of gallic acid were charged into the flask. The contents of the flask were heated to 235° C. in a nitrogen atmosphere while stirring and held at 235° C. for 5 h, and then the pressure within the flask was reduced and held under 8 kPa for 1 h. Thereafter, the contents of the flask were cooled to 160° C., and 761 g of a paraffin wax "HNP-9" (melting point: 75° C.) available from Nippon Seiro Co., Ltd., was added to the flask. While maintaining the contents of the flask at 160° C., a mixture of 1958 g of styrene, 489 g of stearyl methacrylate, 100 g of acrylic acid and 294 g of dibutyl peroxide was further added dropwise to the flask over 1 h. Thereafter, the contents of the flask were held at 160° C. for 30 min, and then heated to 200° C., and further the pressure within the flask was reduced and held under 8 kPa for 1 h. Then, after the pressure within the flask was returned to atmospheric pressure, 698 g of adipic acid and 83 g of trimellitic anhydride were added to the flask, and the contents of the flask were heated to 220° C. and held at that temperature for 1 h. Thereafter, the reaction was carried out under 8 kPa until a softening point of the resulting resin reached a desired value, thereby obtaining a mixture containing a composite resin X1 and the wax. Properties of the resulting product are shown in Table 1.

Production Examples 2, 4 to 8 and 11

(Production of Composite Resins X2, X4 to X7 and X11 and Comparative Resin X8)

The same procedure as in Production Example 1 was repeated except that the composition of the raw material was changed as shown in Table 1, thereby obtaining mixtures containing any of composite resins X2, X4 to X7 and X11 and comparative resin X8, and the wax. Properties of the resulting mixtures are shown in Table 1.

Production Example 3

(Production of Composite Resin X3)

An inside atmosphere of a four-necked flask equipped with a nitrogen inlet tube, a dehydration tube, a stirrer and a thermocouple was replaced with nitrogen, and 3042 g of polyoxypropylene (2.2)-2,2-bis(4-hydroxyphenyl)propane, 577 g of terephthalic acid, 30 g of tin (II) di(2-ethyl hexanoate) and 3 g of gallic acid were charged into the flask. The contents of the flask were heated to 235° C. in a nitrogen atmosphere while stirring and held at 235° C. for 5 h, and then the pressure within the flask was reduced and held under 8 kPa for 1 h. Thereafter, the contents of the flask were cooled to 160° C., and a mixture of 1958 g of styrene, 489 g of stearyl methacrylate, 100 g of acrylic acid and 294 g of dibutyl peroxide was added dropwise to the flask over 1 h. Thereafter, the contents of the flask were held at 160° C. for 30 min, and then heated to 200° C., and further the pressure within the flask was reduced and held under 8 kPa for 1 h. Then, after the pressure within the flask was returned to atmospheric pressure, 698 g of adipic acid and 83 g of trimellitic anhydride were added to the flask, and the contents of the flask were heated to 220° C. and held at that temperature for 1 h. Thereafter, the reaction was carried out under 8 kPa until a softening point of the resulting resin reached a desired value, thereby obtaining a composite resin X3. Properties of the resulting product are shown in Table 1.

Production Example 9

(Production of Comparative Resin X9)

An inside atmosphere of a four-necked flask equipped with a nitrogen inlet tube, a dehydration tube, a stirrer and a thermocouple was replaced with nitrogen, and 5314 g of polyoxypropylene (2.2)-2,2-bis(4-hydroxyphenyl)propane, 1008 g of terephthalic acid, 30 g of tin (II) di(2-ethyl hexanoate) and 3 g of gallic acid were charged into the flask. The contents of the flask were heated to 235° C. in a nitrogen atmosphere while stirring and held at 235° C. for 5 h, and then the pressure within the flask was reduced and held under 8 kPa for 1 h. Thereafter, the contents of the flask were cooled to 160° C., and 761 g of a paraffin wax "HNP-9" (melting point: 75° C.) available from Nippon Seiro Co., Ltd., was added to the flask. Then, the contents of the flask were heated to 180° C., and 887 g of adipic acid and 292 g of trimellitic anhydride were added to the flask, and the contents of the flask were heated to 220° C. and held at that temperature for 1 h. Thereafter, the reaction was carried out under a reduced pressure of 8 kPa until a softening point of the resulting resin reached a desired value, thereby obtaining a mixture containing a comparative resin X9 and the wax. Properties of the resulting product are shown in Table 1.

Production Example 10

(Production of Composite Resin X10)

An inside atmosphere of a four-necked flask equipped with a nitrogen inlet tube, a dehydration tube, a stirrer and a thermocouple was replaced with nitrogen, and 2991 g of polyoxypropylene (2.2)-2,2-bis(4-hydroxyphenyl)propane, 397 g of terephthalic acid, 30 g of tin (II) di(2-ethyl hexanoate) and 3 g of gallic acid were charged into the flask. The contents of the flask were heated to 235° C. in a nitrogen atmosphere while stirring and held at 235° C. for 5 h, and then the pressure within the flask was reduced and held under 8 kPa for 1 h. Thereafter, the contents of the flask were cooled to 160° C., and 761 g of a paraffin wax "HNP-9" (melting point: 75° C.) available from Nippon Seiro Co., Ltd., was added to the flask. While maintaining the contents of the flask at 160° C., a mixture of 1961 g of styrene, 490 g of stearyl methacrylate, 100 g of acrylic acid and 294 g of dibutyl peroxide was further added dropwise to the flask over 1 h. Thereafter, the contents of the flask were held at 160° C. for 30 min, and then heated to 200° C., and further the pressure within the flask was reduced and held under 8 kPa for 1 h. Then, after the pressure within the flask was returned to atmospheric pressure, the content of the flask were cooled to 180° C., and 159 g of fumaric acid, 691 g of sebacic acid, 164 g of trimellitic anhydride and 3.8 g of 4-tert-butyl catechol were added to the flask, and the contents of the flask were heated to 220° C. at a temperature rise rate of 10° C./h. Thereafter, the reaction was carried out under 10 kPa until a softening point of the resulting resin reached a desired value, thereby obtaining a mixture containing composite resin X10 and the wax. Properties of the resulting product are shown in Table 1.

Production Example 12

(Production of Composite Resin X12)

The same procedure as in Production Example 10 was repeated except that the composition of the raw material was changed as shown in Table 1, thereby obtaining a mixture containing composite resin X12 and the wax. Properties of the resulting product are shown in Table 1.

[Production of Polyester Resins for Shell Portion]

Production Example 13

(Production of Polyester Resin Y1)

An inside atmosphere of a four-necked flask equipped with a nitrogen inlet tube, a dehydration tube, a stirrer and a thermocouple was replaced with nitrogen, and 5048 g of polyoxyethylene (2.2)-2,2-bis(4-hydroxyphenyl)propane, 1676 g of terephthalic acid, 30 g of tin (II) di(2-ethyl hexanoate) and 3 g of gallic acid were charged into the flask. The contents of the flask were heated to 235° C. in a nitrogen atmosphere while stirring and held at 235° C. for 5 h. Then, the contents of the flask were cooled to 180° C., and 270 g of fumaric acid, 208 g of dodecenylsuccinic anhydride, 298 g of trimellitic anhydride and 3.8 g of 4-tert-butyl catechol were added to the flask, and the contents of the flask were heated to 220° C. at a temperature rise rate of 10° C./h. Thereafter, the reaction was carried out under 10 kPa until a softening point of the resulting resin reached a desired value, thereby obtaining a polyester resin Y1. Properties of the resulting product are shown in Table 2.

Production Examples 14 and 15

(Production of Polyester Resins Y2 and Y3)

The same procedure as in Production Example 13 was repeated except that the raw material monomer for the polyester resin was changed as shown in Table 2, thereby obtaining polyester resins Y2 and Y3. Properties of the resulting products are shown in Table 2.

TABLE 1-1

| | Production Example 1 | | Production Example 2 | | Production Example 3 | | Production Example 4 | |
|---|---|---|---|---|---|---|---|---|
| Resin | X1 | | X2 | | X3 | | X4 | |
| Raw material monomer (A) of polyester segment | g | mole part*2 | g | mole part*2 | g | mole part*2 | g | mole part*2 |
| Alcohol component | | | | | | | | |
| BPA-PO(*1) | 3042 | 100 | 3042 | 100 | 3042 | 100 | 3549 | 100 |
| BPA-EO(*1) | — | — | — | — | — | — | — | — |
| Acid component | | | | | | | | |
| Terephthalic acid | 577 | 40 | 577 | 40 | 577 | 40 | 673 | 40 |
| Adipic acid | 698 | 55 | 698 | 55 | 698 | 55 | 814 | 55 |
| Sebacic acid | — | — | — | — | — | — | — | — |
| Fumaric acid | — | — | — | — | — | — | — | — |
| Trimellitic anhydride | 83 | 5 | 83 | 5 | 83 | 5 | 97 | 5 |
| Bireactive monomer | | | | | | | | |
| Acrylic acid | 100 | 16 | 100 | 16 | 100 | 16 | 117 | 16 |
| Raw material monomer (B) of vinyl-based resin segment | g | % by mass*3 | g | % by mass*3 | g | % by mass*3 | g | % by mass*3 |
| Styrene | 1958 | 80 | 1958 | 80 | 1958 | 80 | 1468 | 80 |
| Stearyl (C18) methacrylate | 489 | 20 | — | — | 489 | 20 | 367 | 20 |
| 2-Ethylhexyl acrylate | — | — | 489 | 20 | — | — | — | — |
| Wax | | | | | | | | |
| Paraffin wax "HNP-9" (g) | 761 | | 761 | | — | | 761 | |
| Esterification catalyst | | | | | | | | |
| Tin (II) di(2-ethyl hexanoate) (g) | 30 | | 30 | | 30 | | 30 | |
| Esterification co-catalyst | | | | | | | | |
| Gallic acid (g) | 3 | | 3 | | 3 | | 3 | |
| Radical polymerization initiator | | | | | | | | |
| Dibutyl peroxide (g) | 294 | | 294 | | 294 | | 220 | |

-continued

| | | | | |
|---|---|---|---|---|
| Radical polymprization inhibitor | | | | |
| 4-tert-Butyl catechol | — | — | — | — |
| Properties | | | | |
| Content (% by mass) of vinyl-based resin segment in composite resin*4 | 40 | 40 | 40 | 30 |
| Composite resin or polyester resin | | | | |
| Softening point (° C.) | — | — | 97 | — |
| Glass transition temperature (° C.) | — | — | 43 | — |
| Acid value (mgKOH/g) | — | — | 25 | — |
| Mixture containing composite resin and wax | | | | |
| Softening point (° C.) | 89 | 90 | — | 91 |
| Glass transition temperature (° C.) | 42 | 42 | — | 43 |
| Acid value (mgKOH/g) | 25 | 24 | — | 25 |

TABLE 1-2

| | Production Example 5 | | Production Example 6 | | Production Example 7 | | Production Example 8 | |
|---|---|---|---|---|---|---|---|---|
| Resin | X5 | | X6 | | X7 | | X8 | |
| Raw material monomer (A) of polyester segment | g | mole part*2 | g | mole part*2 | g | mole part*2 | g | mole part*2 |
| Alcohol component | | | | | | | | |
| BPA-PO(*1) | 2534 | 100 | 4056 | 100 | 2604 | 85 | — | — |
| BPA-EO(*1) | — | — | — | — | 427 | 15 | 2962 | 100 |
| Acid component | | | | | | | | |
| Terephthalic acid | 481 | 40 | 769 | 40 | 581 | 40 | 681 | 45 |
| Adipic acid | 582 | 55 | 930 | 55 | 703 | 55 | 665 | 50 |
| Sebacic acid | — | — | — | — | — | — | — | — |
| Fumaric acid | — | — | — | — | — | — | — | — |
| Trimellitic anhydride | 70 | 5 | 111 | 5 | 84 | 5 | 88 | 5 |
| Bireactive monomer | | | | | | | | |
| Acrylic acid | 83 | 16 | 134 | 16 | 101 | 16 | 105 | 16 |
| Raw material monomer (B) of vinyl-based resin segment | g | % by mass*3 | g | % by mass*3 | g | % by mass*3 | g | % by mass*3 |
| Styrene | 2447 | 80 | 979 | 80 | 1956 | 80 | 1953 | 80 |
| Stearyl (C18) methacrylate | 612 | 20 | 245 | 20 | 489 | 20 | 488 | 20 |
| 2-Ethylhexyl acrylate | — | — | — | — | — | — | — | — |
| Wax | | | | | | | | |
| Paraffin wax "HNP-9" (g) | 761 | | 761 | | 761 | | 761 | |
| Esterification catalyst | | | | | | | | |
| Tin (II) di(2-ethyl hexanoate) (g) | 30 | | 30 | | 30 | | 30 | |
| Esterification co-catalyst | | | | | | | | |
| Gallic acid (g) | 3 | | 3 | | 3 | | 3 | |
| Radical polymerization initiator | | | | | | | | |
| Dibutyl peroxide (g) | 367 | | 147 | | 293 | | 293 | |
| Radical polymprization inhibitor | | | | | | | | |
| 4-tert-Butyl catechol | — | | — | | — | | — | |
| Properties | | | | | | | | |
| Content (% by mass) of vinyl-based resin segment in composite resin*4 | 50 | | 20 | | 40 | | 40 | |
| Composite resin or polyester resin | | | | | | | | |
| Softening point (° C.) | — | | — | | — | | — | |
| Glass transition temperature (° C.) | — | | — | | — | | — | |
| Acid value (mgKOH/g) | — | | — | | — | | — | |
| Mixture containing composite resin and wax | | | | | | | | |
| Softening point (° C.) | 88 | | 92 | | 88 | | 87 | |
| Glass transition temperature (° C.) | 41 | | 44 | | 42 | | 42 | |
| Acid value (mgKOH/g) | 23 | | 25 | | 21 | | 23 | |

-continued

TABLE 1-3

| | Production Example 9 | | Production Example 10 | | Production Example 11 | | Production Example 12 | |
|---|---|---|---|---|---|---|---|---|
| Resin | X9 | | X10 | | X11 | | X12 | |
| Raw material monomer (A) of polyester segment | g | mole part*2 | g | mole part*2 | g | mole part*2 | g | mole part*2 |
| Alcohol component | | | | | | | | |
| BPA-PO(*1) | 5314 | 100 | 2991 | 100 | 3029 | 100 | 3136 | 100 |
| BPA-EO(*1) | — | — | — | — | — | — | — | — |
| Acid component | | | | | | | | |
| Terephthalic acid | 1008 | 40 | 397 | 28 | 719 | 50 | 967 | 65 |
| Adipic acid | 887 | 40 | — | — | 569 | 45 | — | — |
| Sebacic acid | — | — | 691 | 40 | — | — | — | — |
| Fumaric acid | — | — | 159 | 16 | — | — | 208 | 20 |
| Trimellitic anhydride | 292 | 10 | 164 | 10 | 83 | 5 | 86 | 5 |
| Bireactive monomer | | | | | | | | |
| Acrylic acid | — | — | 100 | 16 | 100 | 16 | 103 | 16 |
| Raw material monomer (B) of vinyl-based resin segment | g | % by mass*3 | g | % by mass*3 | g | % by mass*3 | g | % by mass*3 |
| Styrene | — | — | 1961 | 80 | 1947 | 80 | 1940 | 80 |
| Stearyl (C18) methacrylate | — | — | 490 | 20 | 487 | 20 | 485 | 20 |
| 2-Ethylhexyl acrylate | — | — | — | — | — | — | — | — |
| Wax | | | | | | | | |
| Paraffin wax "HNP-9" (g) | 761 | | 761 | | 761 | | 761 | |
| Esterification catalyst | | | | | | | | |
| Tin (II) di(2-ethyl hexanoate) (g) | 30 | | 30 | | 30 | | 30 | |
| Esterification co-catalyst | | | | | | | | |
| Gallic acid (g) | 3 | | 3 | | 3 | | 3 | |
| Radical polymerization initiator | | | | | | | | |
| Dibutyl peroxide (g) | — | | 294 | | 292 | | 291 | |
| Radical polymprization inhibitor | | | | | | | | |
| 4-tert-Butyl catechol | — | | 3.8 | | — | | 3.8 | |
| Properties | | | | | | | | |
| Content (% by mass) of vinyl-based resin segment in composite resin*4 | 0 | | 40 | | 40 | | 40 | |
| Composite resin or polyester resin | | | | | | | | |
| Softening point (° C.) | — | | — | | — | | — | |
| Glass transition temperature (° C.) | — | | — | | — | | — | |
| Acid value (mgKOH/g) | — | | — | | — | | — | |
| Mixture containing composite resin and wax | | | | | | | | |
| Softening point (° C.) | 87 | | 98 | | 96 | | 103 | |
| Glass transition temperature (° C.) | 43 | | 36 | | 50 | | 57 | |
| Acid value (mgKOH/g) | 24 | | 20 | | 22 | | 25 | |

Note

*1BPA-PO: Polyoxypropylene (2.2)-2,2-bis(4-hydroxyphenyl)propane

BPA-EO: Polyoxyethylene (2.2)-2,2-bis(4-hydroxyphenyl)propane

*2Mole part(s) of each monomer constituting the raw material monomer (A) and the bireactive monomer assuming that an amount of the alcohol component in the raw material monomer (A) was 100 mole parts

*3Content (% by mass) of each monomer constituting the raw material monomer (B) based on a total amount of the raw material monomer (B)

*4An amount of the polyester segment was defined as a theoretical yield thereof except for an amount of reaction water, whereas an amount of the vinyl-based resin segment was calculated as its amount inclusive of an amount of the radical polymerization initiator.

TABLE 2

| | Production Example 13 | | Production Example 14 | | Production Example 15 | |
|---|---|---|---|---|---|---|
| Resin | Y1 | | Y2 | | Y3 | |
| Raw material monomer (A) of polyester resin | g | mole part*2 | g | mole part*2 | g | mole part*2 |
| Alcohol component | | | | | | |
| BPA-PO(*1) | — | — | 809 | 15 | 5168 | 100 |
| BPA-EO(*1) | 5048 | 100 | 4257 | 85 | — | — |
| Acid component | | | | | | |
| Terephthalic acid | 1676 | 65 | 1662 | 65 | 1593 | 65 |
| Adipic acid | — | — | — | — | — | — |
| Fumaric acid | 270 | 15 | 268 | 15 | 257 | 15 |
| Dodecenylsuccinic anhydride | 208 | 5 | 207 | 5 | 198 | 5 |
| Trimellitic anhydride | 298 | 10 | 296 | 10 | 284 | 10 |
| Esterification catalyst | | | | | | |
| Tin (II) di(2-ethyl hexanoate) (g) | 30 | | 30 | | 30 | |
| Esterification co-catalyst | | | | | | |
| Gallic acid (g) | 3 | | 3 | | 3 | |
| Radical polymerization inhibitor | | | | | | |
| 4-tert-Butyl catechol | 3.8 | | 3.8 | | 3.8 | |
| Properties | | | | | | |
| Softening point (° C.) | 108 | | 109 | | 112 | |
| Glass transition temperature (° C.) | 60 | | 61 | | 63 | |
| Acid value (mgKOH/g) | 18 | | 19 | | 24 | |

Note

*1BPA-PO: Polyoxypropylene (2.2)-2,2-bis(4-hydroxyphenyl)propane

BPA-EO: Polyoxyethylene (2.2)-2,2-bis(4-hydroxyphenyl)propane

*2Mole part(s) of each monomer constituting the raw material monomer (A) assuming that an amount of the alcohol component in the raw material monomer (A) was 100 mole parts

[Production of Aqueous Dispersions of Resin Particles for Core]

Production Example 16

(Production of Aqueous Dispersion A-1 of Resin Particles)

A 3 L-capacity vessel equipped with a stirrer, a reflux condenser, a dropping funnel, a thermometer and a nitrogen inlet tube was charged with 300 g of the mixture containing the composite resin X1 and the wax, and 90 g of methyl ethyl ketone, and the contents of the vessel were dissolved at 73° C. over 2 h. A 5% by mass sodium hydroxide aqueous solution was added to the resulting solution in such an amount that the degree of neutralization of the composite resin was 50 mol % on the basis of the acid value of the mixture containing the composite resin X1 and the wax, followed by stirring the contents of the vessel for 30 min.

Next, the obtained reaction solution was continuously maintained at 73° C. while stirring at 200 r/min, and 1000 g of deionized water was added thereto over 60 min to subject the solution to phase inversion emulsification. While continuously maintaining the reaction solution at 73° C., methyl ethyl ketone was distilled off therefrom under reduced pressure, thereby obtaining an aqueous dispersion. Thereafter, the resulting aqueous dispersion was cooled to 30° C. while stirring at 280 r/min (peripheral speed: 88 m/min), and then deionized water was added to the aqueous dispersion such that the solid content of the aqueous dispersion was 20% by mass, thereby obtaining an aqueous dispersion A-1 of resin particles. Properties of the resulting product are shown in Table 3.

Production Examples 17 and 20 to 29

(Production of Aqueous Dispersions A-2 and A-5 to A-14 of Resin Particles)

The same procedure as in Production Example 16 was repeated except that the kind of resin used was changed as shown in Table 3, thereby obtaining aqueous dispersions A-2 and A-5 to A-14 of resin particles. Properties of the resulting products are shown in Table 3.

Production Example 18

(Production of Aqueous Dispersion A-3 of Resin Particles)

A 3 L-capacity vessel equipped with a stirrer, a reflux condenser, a dropping funnel, a thermometer and a nitrogen inlet tube was charged with 270 g of the composite resin X3, 30 g of a paraffin wax "HNP-9" (melting point: 75° C.) available from Nippon Seiro Co., Ltd., and 90 g of methyl ethyl ketone, and the contents of the vessel were dissolved at 73° C. over 2 h. A 5% by mass sodium hydroxide aqueous solution was added to the resulting solution in such an amount that the degree of neutralization of the composite resin was 50 mol % on the basis of the acid value of the composite resin, followed by stirring the contents of the vessel for 30 min.

Next, the obtained reaction solution was continuously maintained at 73° C. while stirring at 200 r/min, and 1000 g of deionized water was added thereto over 60 min to subject the solution to phase inversion emulsification. While continuously maintaining the reaction solution at 73° C., methyl ethyl ketone was distilled off therefrom under reduced pressure, thereby obtaining an aqueous dispersion. Thereafter, the resulting aqueous dispersion was cooled to 30° C. while stirring at 280 r/min (peripheral speed: 88 m/min), and then deionized water was added to the aqueous dispersion such that the solid content of the aqueous dispersion was 20% by mass, thereby obtaining an aqueous dispersion A-3 of resin particles. Properties of the resulting product are shown in Table 3.

Production Example 19

(Production of Aqueous Dispersion A-4 of Resin Particles)

The same procedure as in Production Example 18 was repeated except that the wax was replaced with an ester-based wax "WEP-8" (pentaerythritol behenic acid ester; melting point: 78° C.) available from Nippon Seiro Co., Ltd., thereby obtaining an aqueous dispersion A-4 of resin particles. Properties of the resulting product are shown in Table 3.

TABLE 3

| | Production Examples | | | | | | | | | | | | | |
|---|---|---|---|---|---|---|---|---|---|---|---|---|---|---|
| | 16 | 17 | 18 | 19 | 20 | 21 | 22 | 23 | 24 | 25 | 26 | 27 | 28 | 29 |
| No. of aqueous dispersion of resin particles | A-1 | A-2 | A-3 | A-4 | A-5 | A-6 | A-7 | A-8 | A-9 | A-10 | A-11 | A-12 | A-13 | A-14 |

TABLE 3-continued

| | Production Examples | | | | | | | | | | | | | |
|---|---|---|---|---|---|---|---|---|---|---|---|---|---|---|
| | 16 | 17 | 18 | 19 | 20 | 21 | 22 | 23 | 24 | 25 | 26 | 27 | 28 | 29 |
| Resin | X1 (90) | X2 (90) | X3 (90) | X3 (90) | X4 (90) | X5 (90) | X6 (90) | X7 (90) | X8 (90) | X9 (90) | X3 (100) | X10 (90) | X11 (90) | X12 (90) |
| Wax mixed upon synthesis of resin | HNP-9 (10) | HNP-9 (10) | — | — | HNP-9 (10) | HNP-9 (10) | HNP-9 (10) | HNP-9 (10) | HNP-9 (10) | HNP-9 (10) | — | HNP-9 (10) | HNP-9 (10) | HNP-9 (10) |
| Wax mixed upon emulsification | — | — | HNP-9 (10) | WEP-8 (10) | — | — | — | — | — | — | — | — | — | — |
| Volume median particle size $D_{50}$ (μM) of resin particles | 0.44 | 0.49 | 0.53 | 0.51 | 0.47 | 0.49 | 0.51 | 0.45 | 0.51 | 1.4 | 0.16 | 0.43 | 0.45 | 0.45 |
| CV (%) | 31 | 31 | 33 | 32 | 32 | 33 | 32 | 31 | 30 | 47 | 26 | 30 | 31 | 32 |

Note
Numerical values in parentheses indicate contents (% by mass) in resin particles.
HNP-9: Paraffin wax "HNP-9" (melting point: 75° C.) available from Nippon Seiro Co., Ltd.
WEP-8: Ester-based wax "WEP-8" (pentaerythritol behenic acid ester; melting point: 78° C.) available from Nippon Seiro Co., Ltd.

[Production of Aqueous Dispersions of Resin Particles for Shell]

Production Example 30

(Production of Aqueous Dispersion B-1 of Resin Particles)

A 3 L-capacity vessel equipped with a stirrer, a reflux condenser, a dropping funnel, a thermometer and a nitrogen inlet tube was charged with 300 g of the polyester resin Y1 and 90 g of methyl ethyl ketone, and the contents of the vessel were dissolved at 73° C. over 2 h. A 5% by mass sodium hydroxide aqueous solution was added to the resulting solution in such an amount that the degree of neutralization of the polyester resin was 50 mol % on the basis of the acid value of the polyester resin, followed by stirring the contents of the vessel for 30 min.

Next, the obtained reaction solution was continuously maintained at 73° C. while stirring at 280 r/min (peripheral speed: 88 m/min), and 900 g of deionized water was added thereto over 60 min to subject the solution to phase inversion emulsification. While continuously maintaining the reaction solution at 73° C., methyl ethyl ketone was distilled off therefrom under reduced pressure, thereby obtaining an aqueous dispersion. Thereafter, the resulting aqueous dispersion was cooled to 30° C. while stirring at 280 r/min (peripheral speed: 88 m/min), and then deionized water was added to the aqueous dispersion such that the solid content of the aqueous dispersion was 23% by mass, thereby obtaining an aqueous dispersion B-1 of resin particles. Properties of the resulting product are shown in Table 4.

Production Examples 31 and 32

(Production of Aqueous Dispersions B-2 and B-3 of Resin Particles)

The same procedure as in Production Example 30 was repeated except that the kind of polyester resin used was changed as shown in Table 4, thereby obtaining aqueous dispersions B-2 and B-3 of resin particles. Properties of the resulting products are shown in Table 4.

TABLE 4

| | Production Examples | | |
|---|---|---|---|
| | 30 | 31 | 32 |
| No. of aqueous dispersion of resin particles | B-1 | B-2 | B-3 |
| Resin | Y1 | Y2 | Y3 |
| Volume median particle size $D_{50}$ (μm) of resin particles | 0.14 | 0.15 | 0.15 |
| CV (%) | 25 | 24 | 26 |

[Production of Wax Particles]

Production Example 33

(Production of Wax Particle Dispersion C-1)

A 1 L-capacity beaker was charged with 213 g of deionized water and 5.36 g of an aqueous solution of dipotassium alkenyl succinate "LATEMUL (registered tradename) ASK" (concentration of effective ingredients: 28% by mass) available from Kao Corporation, and after dissolving the contents of the beaker, 50 g of a paraffin wax "HNP-9" (melting point: 75° C.) available from Nippon Seiro Co., Ltd., was added thereto. While maintaining the obtained mixture at a temperature of 95 to 98° C., the mixture was stirred using a homomixer, thereby obtaining a preliminary dispersion.

While maintaining the thus obtained preliminary dispersion at a temperature of 90 to 95° C., the preliminary dispersion was treated twice under a pressure 20 MPa using a high-pressure wet-type atomizer "NANOMIZER (registered trademark) NM2-L200-D08" available from Yoshida Kikai Co., Ltd., and then cooled to room temperature, and deionized water was added to the resulting dispersion to control a solid content of the dispersion to 20% by mass, thereby obtaining a wax particle dispersion C-1. The wax particles in the resulting wax particle dispersion had a volume median particle size ($D_{50}$) of 0.44 μm and CV of 40%.

[Production of Colorant Dispersion]

Production Example 34

(Production of Colorant Dispersion D-1)

A 1 L-capacity beaker was charged with 116.2 g of a copper phthalocyanine pigment "ECB-301" available from Dai-Nichi Seika Color & Chemicals Mfg. Co., Ltd., 154.9 g of an anionic surfactant "NEOPELEX (registered tradename) G-15" (a 15% by mass aqueous solution of sodium dodecylbenzenesulfonate) available from Kao Corporation, and 340 g of deionized water. The contents of the beaker were mixed and dispersed using a homogenizer at room temperature for 3 h, and then deionized water was added to the resulting dispersion such that the solid content of the dispersion was 24% by mass, thereby obtaining a colorant dispersion D-1. The colorant particles in the resulting colorant dispersion had a volume median particle size (D50) of 118 nm.

[Production of Toners]

Example 1

(Production of Toner 1)

A 3 L-capacity four-necked flask equipped with a dehydration tube, a stirrer and a thermocouple was charged with 300 g of the aqueous dispersion A-1 of resin particles for core, 15 g of the colorant dispersion D-1, and 6 g of a 10% by mass aqueous solution of a nonionic surfactant "EMULGEN (registered trademark) 150" (a polyoxyethylene (50 mol) lauryl ether) available from Kao Corporation, and the contents of the flask were mixed with each other at 25° C. Then, while stirring the resulting mixture, an aqueous solution prepared by dissolving 17 g of ammonium sulfate in 183 g of deionized water was added dropwise to the mixture at 25° C. over 5 min. Thereafter, the resulting dispersion was heated to 60° C. over 2 h, and maintained at 60° C. until a volume median particle size of aggregated particles therein reached 4.3 μm, thereby obtaining a dispersion of aggregated particles (1).

The thus obtained dispersion of the aggregated particles (1) was cooled to 57° C., and then while heating the dispersion at a rate of 0.8° C./h, 78 g of the aqueous dispersion B-1 of resin particles for shell was added dropwise thereinto at a rate of 0.4 mL/min to obtain a dispersion of aggregated particles (2). The temperature of the dispersion obtained after completion of the dropwise addition was 60° C.

Added to the dispersion of the aggregated particles (2) was a mixed aqueous solution prepared by mixing 12.5 g of an anionic surfactant "EMAL (registered trademark) E27C" (sodium polyoxyethylene laurylethersulfate; concentration of active ingredients: 27% by mass) available from Kao Corporation, and 1200 g of deionized water. Thereafter, the resulting mixture was heated to 67° C. and maintained at 67° C. until a circularity of the resulting particles reached 0.970, thereby obtaining a dispersion of core-shell particles formed by coalescing the aggregated particles.

The resulting dispersion of the core-shell particles was cooled to 30° C., and subjected to suction filtration to separate solid components therefrom. The thus separated solid components were rinsed with deionized water and then dried at 33° C., thereby obtaining toner particles. One hundred parts by mass of the toner particles were charged together with 2.5 parts by mass of a hydrophobic silica "RY50" (number-average particle size: 0.04 μm) available from Nippon Aerosil Co., Ltd., and 1.0 part by mass of a hydrophobic silica "CAB-O-SIL (registered trademark) TS720" (number-average particle size: 0.012 μm) available from Cabot Norit Japan Co. Ltd. into a Henschel mixer, followed by mixing the respective materials in the mixer while stirring. The resulting mixture was then allowed to pass through a 150 mesh sieve, thereby obtaining a toner 1. Properties and evaluation results of the thus obtained toner are shown in Tables 5 and 6.

Examples 2 to 9, 11 to 13, And Comparative Examples 1 to 3

(Production of Toners 2 to 9, 11 to 16)

The same procedure as in Example 1 was repeated except that the composition of the raw material was changed as shown in Tables 5 and 6, thereby obtaining toners 2 to 9, and 11 to 16. Properties and evaluation results of the thus obtained toners are shown in Tables 5 and 6.

Example 10

(Production of Toner 10)

A 3 L-capacity four-necked flask equipped with a dehydration tube, a stirrer and a thermocouple was charged with 300 g of the aqueous dispersion A-11 of resin particles for core, 15 g of the colorant dispersion D-1, 34 g of the wax particle dispersion C-1, and 6 g of a 10% by mass aqueous solution of a nonionic surfactant "EMULGEN (registered trademark) 150" (a polyoxyethylene (50 mol) lauryl ether) available from Kao Corporation, and the contents of the flask were mixed with each other at 25° C. Then, while stirring the resulting mixture, an aqueous solution prepared by dissolving 17 g of ammonium sulfate in 183 g of deionized water was added dropwise to the mixture at 25° C. over 5 min. Thereafter, the resulting dispersion was heated to 60° C. over 2 h, and maintained at 60° C. until a volume median particle size of aggregated particles therein reached 4.3 μm, thereby obtaining a dispersion of aggregated particles (1).

The thus obtained dispersion of the aggregated particles (1) was cooled to 57° C., and then while heating the dispersion at a rate of 0.8° C./h, 78 g of the aqueous dispersion B-1 of resin particles for shell was added dropwise thereinto at a rate of 0.4 mL/min to obtain a dispersion of aggregated particles (2). The temperature of the dispersion obtained after completion of the dropwise addition was 60° C.

Added to the dispersion of the aggregated particles (2) was a mixed aqueous solution prepared by mixing 12.5 g of an anionic surfactant "EMAL (registered trademark) E27C" (sodium polyoxyethylene laurylethersulfate; concentration of active ingredients: 27% by mass) available from Kao Corporation, and 1200 g of deionized water. Thereafter, the resulting mixture was heated to 67° C. and maintained at 67° C. until a circularity of the resulting particles reached 0.970, thereby obtaining a dispersion of core-shell particles formed by coalescing the aggregated particles (2).

The resulting dispersion of the core-shell particles was cooled to 30° C., and subjected to suction filtration to separate solid components therefrom. The thus separated solid components were rinsed with deionized water and then dried at 33° C., thereby obtaining toner particles. One hundred parts by mass of the toner particles were charged together with 2.5 parts by mass of a hydrophobic silica "RY50" (number-average particle size: 0.04 μm) available from Nippon Aerosil Co., Ltd., and 1.0 part by mass of a hydrophobic silica "CAB-O-SIL (registered trademark) TS720" (number-average particle size: 0.012 μm) available from Cabot Norit Japan Co. Ltd., into a Henschel mixer, followed by mixing the respective materials in the mixer while stirring. The resulting mixture was then allowed to pass through a 150 mesh sieve, thereby obtaining a toner 10. Properties and evaluation results of the thus obtained toner are shown in Tables 5 and 6.

Comparative Example 4

(Production of Toner 17)

A 3 L-capacity four-necked flask equipped with a dehydration tube, a stirrer and a thermocouple was charged with 300 g of the aqueous dispersion A-1 of resin particles for core, 15 g of the colorant dispersion D-1, and 6 g of a 10% by mass aqueous solution of a nonionic surfactant "EMULGEN (registered trademark) 150" (a polyoxyethylene (50 mol) lauryl ether) available from Kao Corporation, and the contents of the flask were mixed with each other at 25° C. Then, while stirring the resulting mixture, an aqueous solution prepared by dissolving 17 g of ammonium sulfate in 183 g of deionized water was added dropwise to the mixture at 25° C. over 5 min. Thereafter, the resulting dispersion was heated to 60° C. over 2 h, and maintained at 60° C. until a volume median particle size of aggregated particles therein reached 4.3 μm, thereby obtaining a dispersion of aggregated particles (1).

Added to the thus obtained aggregated particles (1) was a mixed aqueous solution prepared by mixing 10 g of an anionic surfactant "EMAL (registered trademark) E27C" (sodium polyoxyethylene laurylethersulfate; concentration of active ingredients: 27% by mass) available from Kao Corporation, and 1000 g of deionized water. Thereafter, the resulting mixture was heated to 67° C. and maintained at 67° C. until a circularity of the resulting particles reached 0.970, thereby obtaining a dispersion of coalesced aggregated particles.

The resulting dispersion of the coalesced particles was cooled to 30° C., and subjected to suction filtration to separate solid components therefrom. The thus separated solid components were rinsed with deionized water and then dried at 33° C., thereby obtaining toner particles. One hundred parts by mass of the toner particles were charged together with 2.5 parts by mass of a hydrophobic silica "RY50" (number-average particle size: 0.04 μm) available from Nippon Aerosil Co., Ltd., and 1.0 part by mass of a hydrophobic silica "CAB-O-SIL (registered trademark) TS720" (number-average particle size: 0.012 μm) available from Cabot Norit Japan Co. Ltd., into a Henschel mixer, followed by mixing the respective materials in the mixer while stirring. The resulting mixture was then allowed to pass through a 150 mesh sieve, thereby obtaining a toner 17. Properties and evaluation results of the thus obtained toner are shown in Table 5-2.

TABLE 5-1

| | Examples | | | | | | | | | | | | |
|---|---|---|---|---|---|---|---|---|---|---|---|---|---|
| | 1 | 2 | 3 | 4 | 5 | 6 | 7 | 8 | 9 | 10 | 11 | 12 | 13 |
| No. of toner | 1 | 2 | 3 | 4 | 5 | 6 | 7 | 8 | 9 | 10 | 11 | 12 | 13 |
| Core | | | | | | | | | | | | | |
| No. of aqueous dispersion of resin particles | A-1 | A-2 | A-3 | A-4 | A-5 | A-6 | A-7 | A-8 | A-1 | A-11 | A-12 | A-13 | A-14 |
| Resin | X1 | X2 | X3 | X3 | X4 | X5 | X6 | X7 | X1 | X3 | X10 | X11 | X12 |
| Wax mixed upon synthesis of resin | HNP-9 | HNP-9 | — | — | HNP-9 | HNP-9 | HNP-9 | HNP-9 | HNP-9 | — | HNP-9 | HNP-9 | HNP-9 |
| Wax mixed upon emulsification | — | — | HNP-9 | WEP-8 | — | — | — | — | — | — | — | — | — |
| Wax mixed in aggregating step | — | — | — | — | — | — | — | — | — | HNP-9 (C-1) | — | — | — |
| Shell | | | | | | | | | | | | | |
| No. of aqueous dispersion of resin particles | B-1 | B-1 | B-1 | B-1 | B-1 | B-1 | B-1 | B-1 | B-2 | B-1 | B-1 | B-1 | B-1 |
| Resin | Y1 | Y1 | Y1 | Y1 | Y1 | Y1 | Y1 | Y1 | Y2 | Y1 | Y1 | Y1 | Y1 |
| Properties of toner particles | | | | | | | | | | | | | |
| Volume median particle size $D_{50}$ (μM) | 5.1 | 5.0 | 5.1 | 5.0 | 4.9 | 5.1 | 5.0 | 5.0 | 4.9 | 5.0 | 5.0 | 5.1 | 5.1 |
| CV (%) | 18.4 | 19.5 | 18.6 | 18.6 | 18.4 | 19.1 | 18.9 | 18.4 | 18.5 | 25.7 | 18.7 | 18.6 | 18.8 |
| Evaluation | | | | | | | | | | | | | |
| Low-temperature fusing property of toner | | | | | | | | | | | | | |
| Lowest fusing temperature (° C.) | 115 | 115 | 115 | 120 | 115 | 120 | 115 | 115 | 115 | 120 | 110 | 120 | 135 |
| Heat-resistant storage stability of toner | | | | | | | | | | | | | |
| Mass of toner as residue on sieve after allowed to stand at 55° C. for 72 h (g) | 0.1 | 0.8 | 0.2 | 0.3 | 0.2 | 0.1 | 3.5 | 0.8 | 0.6 | 6.7 | 1.4 | 0.1 | 0.1 |

-continued

TABLE 5-2

| | Comparative Examples | | | |
|---|---|---|---|---|
| | 1 | 2 | 3 | 4 |
| No. of toner | 14 | 15 | 16 | 17 |
| Core | | | | |
| No. of aqueous dispersion of resin particles | A-9 | A-10 | A-1 | A-1 |
| Resin | X8 | X9 | X1 | X1 |
| Wax mixed upon synthesis of resin | HNP-9 | HNP-9 | HNP-9 | HNP-9 |
| Wax mixed upon emulsification | — | — | — | — |
| Wax mixed in aggregating step | — | — | — | — |
| Shell | | | | |
| No. of aqueous dispersion of resin particles | B-1 | B-1 | B-3 | — |
| Resin | Y1 | Y1 | Y3 | — |
| Properties of toner particles | | | | |
| Volume median particle size $D_{50}$ (μm) | 5.0 | 5.0 | 5.1 | 4.9 |
| CV (%) | 20.4 | 25.7 | 18.9 | 19.1 |
| Evaluation | | | | |
| Low-temperature fusing property of toner | | | | |
| Lowest fusing temperature (° C.) | 115 | 120 | 115 | 110 |
| Heat-resistant storage stability of toner | | | | |
| Mass of toner as residue on sieve after allowed to stand at 55° C. for 72 h (g) | 9.8 | 14 | 10 | 19 |

Note
HNP-9: Paraffin wax "HNP-9" (melting point: 75° C.) available from Nippon Seiro Co., Ltd.
WEP-8: Ester-based wax "WEP-8" (pentaerythritol behenic acid ester; melting point: 78° C.) available from Nippon Seiro Co., Ltd.

TABLE 6

| | Examples | | | | | | | | | | | | |
|---|---|---|---|---|---|---|---|---|---|---|---|---|---|
| | 1 | 2 | 3 | 4 | 5 | 6 | 7 | 8 | 9 | 10 | 11 | 12 | 13 |
| No. of toner | 1 | 2 | 3 | 4 | 5 | 6 | 7 | 8 | 9 | 10 | 11 | 12 | 13 |
| Core | | | | | | | | | | | | | |
| No. of aqueous dispersion of resin particles | A-1 | A-2 | A-3 | A-4 | A-5 | A-6 | A-7 | A-8 | A-1 | A-11 | A-12 | A-13 | A-14 |
| Resin | X1 | X2 | X3 | X3 | X4 | X5 | X6 | X7 | X1 | X3 | X10 | X11 | X12 |
| Wax mixed upon synthesis of resin | HNP-9 | HNP-9 | — | — | HNP-9 | HNP-9 | HNP-9 | HNP-9 | HNP-9 | — | HNP-9 | HNP-9 | HNP-9 |
| Wax mixed upon emulsification | — | — | HNP-9 | WEP-8 | — | — | — | — | — | — | — | — | — |
| Wax mixed in aggregating step | — | — | — | — | — | — | — | — | — | HNP-9 (C-1) | — | — | — |
| Shell | | | | | | | | | | | | | |
| No. of aqueous dispersion of resin particles | B-1 | B-1 | B-1 | B-1 | B-1 | B-1 | B-1 | B-1 | B-2 | B-1 | B-1 | B-1 | B-1 |
| Resin | Y1 | Y1 | Y1 | Y1 | Y1 | Y1 | Y1 | Y1 | Y2 | Y1 | Y1 | Y1 | Y1 |
| Properties of toner particles | | | | | | | | | | | | | |
| Volume median particle size $D_{50}$ (μM) | 5.1 | 5.0 | 5.1 | 5.0 | 4.9 | 5.1 | 5.0 | 5.0 | 4.9 | 5.0 | 5.0 | 5.1 | 5.1 |
| CV (%) | 18.4 | 19.5 | 18.6 | 18.6 | 18.4 | 19.1 | 18.9 | 18.4 | 18.5 | 25.7 | 18.7 | 18.6 | 18.8 |
| Evaluation | | | | | | | | | | | | | |
| Charge distribution | 0.4 | 0.7 | 0.5 | 0.5 | 0.5 | 0.5 | 0.6 | 0.6 | 0.5 | 1.3 | 0.5 | 0.4 | 0.4 |
| Toner cloud (number of particles) | 39 | 67 | 55 | 58 | 46 | 48 | 81 | 51 | 50 | 287 | 44 | 39 | 35 |
| Dot reproducibility | 5 | 4 | 4 | 4 | 5 | 5 | 4 | 5 | 5 | 2 | 5 | 5 | 5 |

Note
HNP-9: Paraffin wax "HNP-9" (melting point: 75° C.) available from Nippon Seiro Co., Ltd.
WEP-8: Ester-based wax "WEP-8" (pentaerythritol behenic acid ester; melting point: 78° C.) available from Nippon Seiro Co., Ltd.

From Table 5, it was confirmed that the toners obtained in Examples 1 to 13 were excellent in heat-resistant storage stability while maintaining a good low-temperature fusing property, as compared to those toners obtained in Comparative Examples 1 to 4.

Furthermore, from Table 6, it was confirmed that the toners obtained in Examples 1 to 9, 11 to 13 in which the wax was mixed upon synthesis or emulsification of the composite resin, were more excellent in charge stability, toner cloud and dot reproducibility, than the toner obtained in Example 10 in which the wax was mixed in the aggregating step.

The invention claimed is:

1. A process for producing a toner for development of electrostatic images, comprising:

(1) aggregating resin particles (X) comprising a composite resin that comprises a segment of a polyester resin (a) obtained by polycondensing an alcohol component comprising 80 mol % or more of a propyleneoxide adduct of bisphenol A and a polycarboxylic acid component, and a vinyl-based resin segment comprising a constitutional unit derived from a styrene-based compound, in an aqueous medium, to obtain aggregated particles (1);

(2) aggregating the aggregated particles (1) obtained from said (1) aggregating with resin particles (Y) comprising a polyester resin (b) obtained by polycondensing an alcohol component comprising 80 mol % or more of an ethyleneoxide adduct of bisphenol A and a polycarboxylic acid component to obtain aggregated particles (2); and (3) coalescing the aggregated particles (2) obtained from said (2) aggregating.

2. The process for producing a toner for development of electrostatic images according to claim 1, wherein a content of the vinyl-based resin segment in the composite resin is not less than 25% by mass and not more than 60% by mass.

3. The process for producing a toner for development of electrostatic images according to claim 1, wherein a vinyl monomer as a raw material from which the vinyl-based resin segment is derived comprises a vinyl monomer component comprising an alkyl group having not less than 10 and not more than 20 carbon atoms in an amount of not less than 5% by mass and not more than 50% by mass.

4. The process for producing a toner for development of electrostatic images according to claim 1, wherein the vinyl monomer as the raw material from which the vinyl-based resin segment is derived comprises the styrene-based compound in an amount of not less than 50% by mass and not more than 90% by mass.

5. The process for producing a toner for development of electrostatic images according to claim 1, wherein the vinyl-based resin segment comprises a constitutional unit derived from a bireactive monomer.

6. The process for producing a toner for development of electrostatic images according to claim 1, wherein the composite resin has a glass transition temperature of not lower than 30° C. and not higher than 60° C.

7. The process for producing a toner for development of electrostatic images according to claim 1, wherein the resin particles (X) comprise the composite resin and a wax.

8. The process for producing a toner for development of electrostatic images according to claim 7, wherein a content of the wax in the resin particles (X) is 10 not less than 2 parts by mass and not more than 30 parts by mass on the basis of 100 parts by mass of the composite resin.

9. The process for producing a toner for development of electrostatic images according to claim 7, wherein said (1) aggregating further comprises:

(1-1) obtaining a mixture comprising the composite resin that comprises the segment of the polyester resin (a) obtained by polycondensing the alcohol component comprising 80 mol % or more of the propyleneoxide adduct of bisphenol A and the polycarboxylic acid component, and the vinyl-based resin segment comprising a constitutional unit derived from the styrene-based compound, and the wax;

(1-2) adding a neutralizing agent to the mixture containing the composite resin and the wax which is obtained from said (1-1) obtaining, and then adding the aqueous medium thereto to subject the mixture to phase inversion emulsification, thereby obtaining an aqueous dispersion of the resin particles (X); and (1-3) aggregating the resin particles (X) in the aqueous dispersion obtained from said (1-2) adding to obtain the aggregated particles (1).

10. The process for producing a toner for development of electrostatic images according to claim 7, wherein said (1) aggregating further comprises:

(1-1') conducting at least one of a polycondensation reaction of the alcohol component comprising 80 mol % or more of the propyleneoxide adduct of bisphenol A and the polycarboxylic acid component, and an addition polymerization reaction of the vinyl monomer as the raw material from which the vinyl-based resin segment is derived, in the presence of the wax, to obtain a mixture comprising the composite resin and the wax;

(1-2') after adding a neutralizing agent to the mixture comprising the composite resin and the wax which is obtained from said (1-1') conducting, adding the aqueous medium thereto to subject the mixture to phase inversion emulsification, thereby obtaining an aqueous dispersion of the resin particles (X); and aggregating the resin particles (X) in the aqueous dispersion obtained from said (1-2') adding to obtain the aggregated particles (1).

11. The process for producing a toner for development of electrostatic images according to claim 9, wherein the mixture comprising the composite resin and the wax has a glass transition temperature of not lower than 30° C. and not higher than 60° C.

12. The process for producing a toner for development of electrostatic images according to claim 1, wherein a glass transition temperature of the composite resin is not lower than 30° C. and not higher than 55° C.

13. The process for producing a toner for development of electrostatic images according to claim 1, wherein a glass transition temperature of the composite resin is not lower than 40° C. and lower than 55° C.

14. A toner for development of electrostatic images which has a core-shell structure, comprising:

a core portion comprising a composite resin that comprises a segment of a polyester resin (a) obtained by polycondensing an alcohol component comprising 80 mol % or more of a propyleneoxide adduct of bisphenol A and a polycarboxylic acid component, and a vinyl-based resin segment comprising a constitutional unit derived from a styrene-based compound; and a shell portion comprising a polyester resin (b) obtained by polycondensing an alcohol component comprising 80 mol % or more of an ethyleneoxide adduct of bisphenol A and a polycarboxylic acid component.

15. The toner for development of electrostatic images according to claim 14, wherein the composite resin has a glass transition temperature of not lower than 30° C. and not higher than 60° C.

16. The toner for development of electrostatic images according to claim 14, wherein the core portion comprises a wax.

17. The toner for development of electrostatic images according to claim 14, wherein a content of the vinyl-based resin segment in the composite resin is not less than 25% by mass and not more than 60% by mass.

18. The toner for development of electrostatic images according to claim 14, wherein a glass transition temperature of the composite resin is not lower than 30° C. and not higher than 55° C.

19. The toner for development of electrostatic images according to claim 14, wherein a glass transition temperature of the composite resin is not lower than 40° C. and lower than 55° C.

* * * * *